US008545034B2

(12) United States Patent
Maxik et al.

(10) Patent No.: US 8,545,034 B2
(45) Date of Patent: Oct. 1, 2013

(54) DUAL CHARACTERISTIC COLOR CONVERSION ENCLOSURE AND ASSOCIATED METHODS

(75) Inventors: Fredric S. Maxik, Indialantic, FL (US); Robert R. Soler, Cocoa Beach, FL (US); David E. Bartine, Cocoa, FL (US); Eliza Katar Grove, Satellite Beach, FL (US); Mark Andrew Oostdyk, Cape Canaveral, FL (US)

(73) Assignee: Lighting Science Group Corporation, Satellite Beach, FL (US)

( * ) Notice: Subject to any disclaimer, the term of this patent is extended or adjusted under 35 U.S.C. 154(b) by 0 days.

(21) Appl. No.: 13/357,283

(22) Filed: Jan. 24, 2012

(65) Prior Publication Data

US 2013/0188330 A1 Jul. 25, 2013

(51) Int. Cl.
*F21V 9/16* (2006.01)

(52) U.S. Cl.
USPC ..... 362/84; 362/260; 362/293; 362/311.02; 359/290; 359/298; 313/503

(58) Field of Classification Search
USPC ..... 362/84, 311.02, 260, 293; 359/290–293, 359/295, 298; 313/503, 504
See application file for complete search history.

(56) References Cited

U.S. PATENT DOCUMENTS

| | | | |
|---|---|---|---|
| 5,523,878 | A | 6/1996 | Wallace et al. |
| 5,704,701 | A | 1/1998 | Kavanagh et al. |
| 5,813,753 | A | 9/1998 | Vriens et al. |
| 5,997,150 | A | 12/1999 | Anderson |
| 6,140,646 | A | 10/2000 | Busta et al. |
| 6,341,876 | B1 | 1/2002 | Moss et al. |
| 6,356,700 | B1 | 3/2002 | Strobl |
| 6,561,656 | B1 | 5/2003 | Kojima et al. |
| 6,594,090 | B2 | 7/2003 | Kruschwitz et al. |
| 6,733,135 | B2 | 5/2004 | Dho |
| 6,767,111 | B1 | 7/2004 | Lai |
| 6,817,735 | B2 | 11/2004 | Shimizu et al. |
| 6,870,523 | B1 | 3/2005 | Ben-David et al. |
| 6,871,982 | B2 | 3/2005 | Holman et al. |
| 6,967,761 | B2 | 11/2005 | Starkweather et al. |
| 6,974,713 | B2 | 12/2005 | Patel et al. |
| 7,042,623 | B1 | 5/2006 | Huibers et al. |

(Continued)

FOREIGN PATENT DOCUMENTS

| | | |
|---|---|---|
| EP | 0851260 | 7/1998 |
| WO | WO2012/135173 | 10/2012 |

OTHER PUBLICATIONS

U.S. Appl. No. 13/073,805, filed Mar. 28, 2011, Maxik et al.
U.S. Appl. No. 13/234,371, filed Sep. 16, 2011, Maxik et al.

(Continued)

*Primary Examiner* — Stephen F Husar
*Assistant Examiner* — Meghan Dunwiddie
(74) *Attorney, Agent, or Firm* — Mark R. Malek; Keith Olinga Mitchell; Zies Widerman & Malek

(57) ABSTRACT

A light converting device includes a wide production conversion material and a narrow production conversion material to convert the source light into a first and second interim light, respectively. The conversion materials may be included in, or applied to, an enclosure. The first and second interim light may be included in a converted light. The converted light may be included with the source light to create a white light. The wide production conversion material may have wide absorption and scatter characteristics. The narrow production conversion material may have narrow absorption and scatter characteristics to substantially reduce inefficiencies caused by double conversion of light.

63 Claims, 13 Drawing Sheets

(56) References Cited

U.S. PATENT DOCUMENTS

| | | | |
|---|---|---|---|
| 7,070,281 | B2 | 7/2006 | Kato |
| 7,072,096 | B2 | 7/2006 | Holman et al. |
| 7,075,707 | B1 | 7/2006 | Rapaport et al. |
| 7,083,304 | B2 | 8/2006 | Rhoads |
| 7,178,941 | B2 | 2/2007 | Roberge et al. |
| 7,184,201 | B2 | 2/2007 | Duncan |
| 7,187,484 | B2 | 3/2007 | Mehrl |
| 7,213,926 | B2 | 5/2007 | May et al. |
| 7,246,923 | B2 | 7/2007 | Conner |
| 7,247,874 | B2 | 7/2007 | Bode et al. |
| 7,255,469 | B2 | 8/2007 | Wheatley et al. |
| 7,261,453 | B2 | 8/2007 | Morejon et al. |
| 7,289,090 | B2 | 10/2007 | Morgan |
| 7,300,177 | B2 | 11/2007 | Conner |
| 7,303,291 | B2 | 12/2007 | Ikeda et al. |
| 7,325,956 | B2 | 2/2008 | Morejon et al. |
| 7,342,658 | B2 | 3/2008 | Kowarz et al. |
| 7,344,279 | B2 | 3/2008 | Mueller et al. |
| 7,349,095 | B2 | 3/2008 | Kurosaki |
| 7,353,859 | B2 | 4/2008 | Stevanovic et al. |
| 7,382,091 | B2 | 6/2008 | Chen |
| 7,382,632 | B2 | 6/2008 | Alo et al. |
| 7,400,439 | B2 | 7/2008 | Holman |
| 7,427,146 | B2 | 9/2008 | Conner |
| 7,429,983 | B2 | 9/2008 | Islam |
| 7,434,946 | B2 | 10/2008 | Huibers |
| 7,438,443 | B2 | 10/2008 | Tatsuno et al. |
| 7,476,016 | B2 | 1/2009 | Kurihara |
| 7,520,642 | B2 | 4/2009 | Holman et al. |
| 7,530,708 | B2 | 5/2009 | Park |
| 7,537,347 | B2 | 5/2009 | Dewald |
| 7,540,616 | B2 | 6/2009 | Conner |
| 7,556,406 | B2 | 7/2009 | Petroski et al. |
| 7,598,686 | B2 | 10/2009 | Lys et al. |
| 7,605,971 | B2 | 10/2009 | Ishii et al. |
| 7,626,755 | B2 | 12/2009 | Furuya et al. |
| 7,677,736 | B2 | 3/2010 | Kasazumi et al. |
| 7,684,007 | B2 | 3/2010 | Hull et al. |
| 7,703,943 | B2 | 4/2010 | Li et al. |
| 7,705,810 | B2 | 4/2010 | Choi et al. |
| 7,709,811 | B2 | 5/2010 | Conner |
| 7,719,766 | B2 | 5/2010 | Grasser et al. |
| 7,728,846 | B2 | 6/2010 | Higgins et al. |
| 7,732,825 | B2 | 6/2010 | Kim et al. |
| 7,766,490 | B2 | 8/2010 | Harbers et al. |
| 7,819,556 | B2 | 10/2010 | Heffington et al. |
| 7,828,453 | B2 | 11/2010 | Tran et al. |
| 7,828,465 | B2 | 11/2010 | Roberge et al. |
| 7,832,878 | B2 | 11/2010 | Brukilacchio et al. |
| 7,834,867 | B2 | 11/2010 | Sprague et al. |
| 7,835,056 | B2 | 11/2010 | Doucet et al. |
| 7,841,714 | B2 | 11/2010 | Gruber |
| 7,845,823 | B2 | 12/2010 | Mueller et al. |
| 7,871,839 | B2 | 1/2011 | Lee |
| 7,880,400 | B2 | 2/2011 | Zhoo et al. |
| 7,889,430 | B2 | 2/2011 | El-Ghoroury et al. |
| 7,906,789 | B2 | 3/2011 | Jung et al. |
| 7,928,565 | B2 | 4/2011 | Brunschwiler et al. |
| 7,972,030 | B2 | 7/2011 | Li |
| 7,976,205 | B2 | 7/2011 | Grotsch et al. |
| 8,016,443 | B2 | 9/2011 | Falicoff et al. |
| 8,040,070 | B2 | 10/2011 | Myers et al. |
| 8,047,660 | B2 | 11/2011 | Penn et al. |
| 8,049,763 | B2 | 11/2011 | Kwak et al. |
| 8,061,857 | B2 | 11/2011 | Liu et al. |
| 8,070,302 | B2 | 12/2011 | Hatanaka et al. |
| 8,076,680 | B2 | 12/2011 | Lee et al. |
| 8,083,364 | B2 | 12/2011 | Allen |
| 8,096,668 | B2 | 1/2012 | Abu-Ageel |
| 8,115,419 | B2 | 2/2012 | Given et al. |
| 8,188,687 | B2 | 5/2012 | Lee et al. |
| 2003/0039036 | A1 | 2/2003 | Kruschwitz et al. |
| 2004/0052076 | A1 | 3/2004 | Mueller et al. |
| 2004/0218390 | A1 | 11/2004 | Holman et al. |
| 2005/0174768 | A1 | 8/2005 | Conner |
| 2005/0190430 | A1 | 9/2005 | Patel et al. |
| 2005/0218780 | A1 | 10/2005 | Chen |
| 2006/0002101 | A1 | 1/2006 | Wheatley et al. |
| 2006/0002108 | A1 | 1/2006 | Ouderkirk et al. |
| 2006/0002110 | A1 | 1/2006 | Dowling et al. |
| 2006/0164005 | A1 | 7/2006 | Sun |
| 2006/0164607 | A1 | 7/2006 | Morejon et al. |
| 2006/0232992 | A1 | 10/2006 | Bertram et al. |
| 2006/0285078 | A1 | 12/2006 | Kasazumi et al. |
| 2006/0285193 | A1 | 12/2006 | Kimura et al. |
| 2006/0291269 | A1 | 12/2006 | Doucet et al. |
| 2007/0013871 | A1 | 1/2007 | Marshall et al. |
| 2007/0146639 | A1 | 6/2007 | Conner |
| 2007/0159492 | A1 | 7/2007 | Lo et al. |
| 2007/0188847 | A1 | 8/2007 | McDonald et al. |
| 2007/0211449 | A1 | 9/2007 | Holman et al. |
| 2007/0241340 | A1 | 10/2007 | Pan |
| 2007/0263298 | A1 | 11/2007 | El-Ghoroury et al. |
| 2007/0273794 | A1 | 11/2007 | Sprague et al. |
| 2008/0062644 | A1 | 3/2008 | Petroski |
| 2008/0143970 | A1 | 6/2008 | Harbers et al. |
| 2008/0143973 | A1 | 6/2008 | Wu |
| 2008/0198572 | A1 | 8/2008 | Medendorp |
| 2008/0218992 | A1 | 9/2008 | Li |
| 2008/0232084 | A1 | 9/2008 | Kon |
| 2008/0258643 | A1 | 10/2008 | Cheng et al. |
| 2008/0285271 | A1 | 11/2008 | Roberge et al. |
| 2008/0316432 | A1 | 12/2008 | Tejada et al. |
| 2009/0009102 | A1 | 1/2009 | Kahlman et al. |
| 2009/0046307 | A1 | 2/2009 | Kwak et al. |
| 2009/0059099 | A1 | 3/2009 | Linkov et al. |
| 2009/0059585 | A1 | 3/2009 | Chen et al. |
| 2009/0128781 | A1 | 5/2009 | Li |
| 2009/0129079 | A1 | 5/2009 | Grotsch et al. |
| 2009/0160370 | A1 | 6/2009 | Tai et al. |
| 2009/0232683 | A1 | 9/2009 | Hirata et al. |
| 2009/0261748 | A1 | 10/2009 | McKinney et al. |
| 2009/0262516 | A1 | 10/2009 | Li |
| 2009/0273918 | A1 | 11/2009 | Falicoff et al. |
| 2009/0273931 | A1 | 11/2009 | Ito et al. |
| 2010/0006762 | A1 | 1/2010 | Yoshida et al. |
| 2010/0046234 | A1 | 2/2010 | Abu-Ageel |
| 2010/0051976 | A1 | 3/2010 | Rooymans |
| 2010/0053959 | A1 | 3/2010 | Ljzerman et al. |
| 2010/0060181 | A1 | 3/2010 | Choi et al. |
| 2010/0061068 | A1 | 3/2010 | Geissler et al. |
| 2010/0061078 | A1 | 3/2010 | Kim |
| 2010/0072494 | A1 | 3/2010 | Lee |
| 2010/0103389 | A1 | 4/2010 | McVea et al. |
| 2010/0110516 | A1 | 5/2010 | Penn et al. |
| 2010/0128233 | A1 | 5/2010 | Liu et al. |
| 2010/0165599 | A1 | 7/2010 | Allen |
| 2010/0202129 | A1 | 8/2010 | Abu-Ageel |
| 2010/0213859 | A1 | 8/2010 | Shteynberg et al. |
| 2010/0231136 | A1 | 9/2010 | Reisenauer et al. |
| 2010/0231863 | A1 | 9/2010 | Hikmet et al. |
| 2010/0232134 | A1 | 9/2010 | Tran |
| 2010/0244700 | A1 | 9/2010 | Chong et al. |
| 2010/0244724 | A1 | 9/2010 | Jacobs et al. |
| 2010/0270942 | A1 | 10/2010 | Hui et al. |
| 2010/0277084 | A1 | 11/2010 | Lee et al. |
| 2010/0302464 | A1 | 12/2010 | Raring et al. |
| 2010/0308738 | A1 | 12/2010 | Shteynberg et al. |
| 2010/0308739 | A1 | 12/2010 | Shteynberg et al. |
| 2010/0315320 | A1 | 12/2010 | Yoshida |
| 2010/0320927 | A1 | 12/2010 | Gray et al. |
| 2010/0320928 | A1 | 12/2010 | Kaihotsu et al. |
| 2010/0321641 | A1 | 12/2010 | Van Der Lubbe |
| 2010/0321933 | A1 | 12/2010 | Hatanaka et al. |
| 2011/0012137 | A1 | 1/2011 | Lin et al. |
| 2011/0080635 | A1 | 4/2011 | Takeuchi |
| 2012/0250137 | A1 | 10/2012 | Maxik et al. |

OTHER PUBLICATIONS

U.S. Appl. No. 13/633,914, filed Oct. 3, 2012, Maxik et al.

Arthur P. Fraas, Heat Exchanger Design, 1989, p. 60, John Wiley & Sons, Inc., Canada.

H. A El-Shaikh, S. V. Garimella, "Enhancement of Air Jet Impingement Heat Transfer using Pin-Fin Heat Sinks", D IEEE Transactions on Components and Packaging Technology, Jun. 2000, vol. 23, No. 2.

Jones, Eric D., Light Emitting Diodes (LEDS) for General Lumination, an Optoelectronics Industry Development Association (OIDA) Technology Roadmap, OIDA Report, Mar. 2001, published by OIDA in Washington D.C.

J. Y. San, C. H. Huang, M. H, Shu, "Impingement cooling of a confined circular air jet", In t. J. Heat Mass Transf., 1997. pp. 1355-1364, vol. 40.

N. T. Obot, W. J. Douglas, A S. Mujumdar, "Effect of Semi-confinement on Impingement Heat Transfer", Proc. 7th Int. Heat Transf. Conf., 1982, pp. 1355-1364. vol. 3.

S. A Solovitz, L. D. Stevanovic, R. A Beaupre, "Microchannels Take Heatsinks to the Next Level", Power Electronics Technology, Nov. 2006.

Yongmann M. Chung, Kai H. Luo, "Unsteady Heat Transfer Analysis of an Impinging Jet", Journal of Heat Transfer—Transactions of the ASME, Dec. 2002, pp. 1039-1048, vol. 124, No. 6.

Tannith Cattermole, "Smart Energy Glass controls light on demand", Gizmag.com, Apr. 18, 2010, accessed Nov. 1, 2011.

DUAL CHARACTERISTIC COLOR CONVERSION ENCLOSURE AND ASSOCIATED METHODS

FIELD OF THE INVENTION

The present invention relates to the field of enclosures for lighting devices and, more specifically, to increasing efficiency of light color conversion by including a wide production conversion material and a narrow production conversion material with the enclosure.

BACKGROUND OF THE INVENTION

Lighting devices that include conversion materials may conveniently allow the conversion of light from a source light into light of a different wavelength range. Often, such conversion may be performed by using a luminescent, fluorescent, or phosphorescent material. These wavelength conversion materials may sometimes be included in the bulk material of another object, applied to a lens or optic, or otherwise located in line with the light emitted from a light source and a space to be illuminated. In some instances the conversion material may be applied to the light source itself. A number of disclosed inventions exist that describe lighting devices that utilize a conversion material applied to an LED to convert light with a source wavelength range into light of a converted wavelength range.

However, to achieve a desired chromaticity of converted light, such as, for example, a warm white light, a substantial amount of phosphor conversion materials may be required to produce a light within a desired wavelength range. For example, yellow and red phosphor conversion coatings are used in combination to create warm white light. However, using a plurality of phosphor coatings may result in double conversion of light due to luminous flux. This double conversion may best be illustrated in FIGS. 15-16 of this disclosure.

Referring to FIG. 15, an illustrative dual characteristic color conversion that may be performed according to the prior art will now be discussed. In this illustrative conversion, a plurality of phosphor conversion materials may be included on or in an enclosure to perform a plurality of color conversion to the source light. However, the phosphors may perform repeated color conversions on overlapping wavelength ranges of source light.

For example, a first phosphor may absorb essentially the wavelength range of source light, as indicated by the first range 78. This wavelength range may correspond with a yellow phosphor. A second phosphor may absorb a different, but partially overlapping wavelength range of source light, as indicated by the second range 79. This wavelength range may correspond with a red phosphor. The second range 79 may overlap a substantial portion of the source wavelength range, allowing the second phosphor to convert at least part of the source light left unconverted by the first phosphor. However, the second phosphor may also convert a significant portion of light that has already been converted by the first phosphor. This double conversion wastes energy and reduces efficiency. As illustrated by the waveform 76 of FIG. 16, the converted light may have an approximately white chromaticity but lack the luminosity of an efficient lighting device.

This double conversion can result in substantial losses of lighting efficacy (lumens/watt), on the order of thirty to forty percent. Additionally, phosphor materials may also inefficiently absorb the high energy wavelength range of blue light, leaving an undesired residual wavelength range of unconverted light.

In the past, proposed solutions have attempted to use conversion materials that included a plurality of wide production conversion materials, such as phosphors to convert a source light into a converted light prior to illuminating a space with a desired color of light. However, including additional the conversion materials does not address the inefficiency caused by the wide conversion wavelength range characteristics double conversion operation due to performing a plurality of wide production conversion operations.

Also, LEDs and other lighting elements may generate heat during operation. Applying a conversion material directly upon a lighting element may cause the material to be exposed to an excessive amount of heat resulting in decreased operational efficiency of the conversion material.

There exists a need for an enclosure for lighting devices that provides an ability to receive a light emitted from a light source in one wavelength range, convert the source light into a converted light within a converted wavelength range by performing a wide production wavelength conversion and a narrow production wavelength conversion, and direct the converted light in a desired output direction. There further exists a need for a light converting device that performs the wavelength conversion operation away from a heat generating light source.

SUMMARY OF THE INVENTION

With the foregoing in mind, the present invention is related to a light converting device that provides an ability to receive a source light emitted from a light source in one wavelength range, convert the source light into a converted light within a converted wavelength range, and project the converted light in a desired output direction. The light converting device may advantageously perform both a wide production wavelength conversion and a narrow production wavelength conversion to create the converted light. The light converting device of the present invention may additionally perform the wavelength conversion operation away from a heat generating light source. By providing a light converting device that advantageously performs both a wide and a narrow production light conversion operation, away from the heat generating light source, the present invention may beneficially possess characteristics of reduced complexity, size, and manufacturing expense. Additionally, by including dual characteristic conversion materials with a light source, a high efficacy color conversion may advantageously be achieved due a reduction repeated conversions to the same light. By providing this light converting device of the embodiments of the present invention, associated lighting devices may achieve emission of visible light, such as white light, with increase luminosity using a similar or reduced amount of electrical current.

These and other objects, features, and advantages according to the present invention are provided by a light converting device comprising an enclosure having an inner surface and an outer surface, a wide production conversion material, and a narrow production conversion material. The wide production conversion material may be applied to at least part of the enclosure to convert a source light within a source wavelength range into an first interim light within a first interim wavelength range. Similarly, the narrow production conversion material may be applied to at least part of the enclosure to convert the source light within the source wavelength range into a second interim light within a second interim wavelength range. The first interim light and second interim light may be included together as converted light. The converted light may be included with the source light as white light. The converted light may also be directed in a desired output direction.

The wide production conversion material may be included in at least part of the enclosure to convert a source light within a source wavelength range into a first interim light within a first interim wavelength range. Similarly, the narrow production conversion material may be included in at least part of the enclosure to convert the source light within the source wavelength range into a second interim light within a second interim wavelength range. The first interim light and the second interim light may be included together to create the converted light within the converted wavelength range that may be directed to a desired output direction. The converted light may combined with at least some of the source light to create white light.

The wide production conversion coating may include phosphors, quantum dots, fluorescent, and/or luminescent materials. Similarly, the narrow production conversion coating may include phosphors, quantum dots, fluorescent, and/or luminescent materials. The wide production conversion coating may be located on the inner and/or outer surface of the enclosure. The wide production conversion material may also be located adjacent to the light source. Alternately, the conversion coating may be included in a material comprising the enclosure.

The narrow production conversion material may additionally be located on the inner and/or outer surface of the enclosure or included in a material comprising the enclosure. The narrow production conversion material may also be located adjacent to the light source. Additionally, the wide production conversion material and narrow production conversion material may be both included in the bulk of the material, such that light may be converted by the wide production conversion material and the narrow production conversion material approximately simultaneously.

The source light may be a monochromatic light. Additionally, the source wavelength range may be between 200 nanometers and 500 nanometers. Additionally, the source wavelength range may be between 500 nanometers and 1300 nanometers. Furthermore, the source light may be emitted by a light source. The light source may be a light emitting semiconductor, such as an LED, laser based lighting device, or an electroluminescent lighting device. The light source may be at least partially enclosed in the enclosure.

The wide production conversion material may be defined by wide absorption characteristics. The narrow production conversion material may be defined by narrow absorption characteristics. The narrow production conversion material may absorb at least some of the source light within the source wavelength range that may not have been absorbed or at least partially produced by the wide production conversion material. Alternately, the wide production conversion material may absorb at least some of the light within the source wavelength range that may not have been absorbed or at least partially produced by the narrow production conversion material.

The wide production conversion material may be defined by wide scatter characteristics, and the narrow production conversion material may be defined by narrow scatter characteristics. The wide production conversion material may scatter at least some of the source light absorbed from within the source wavelength range that may have not been absorbed by the narrow production conversion material. Similarly, the narrow production conversion material may scatter at least some of the source light absorbed from within the source wavelength range that may not have been absorbed by the wide production conversion material. The scattering may be achieved using the wide production conversion material and narrow production conversion material by emitting the first interim light and the second interim light, within the first interim wavelength range and the second interim wavelength range, respectively. The first interim light and second interim light may collectively be included as converted light within the converted wavelength range.

A method aspect, according to an embodiment of the present invention, is for using a light converting device to convert a source light within a source wavelength range into a converted light within a converted wavelength range. The method may involve including a wide production conversion material in at least part of an enclosure, and including a narrow production conversion coating in at least part of the enclosure. Additionally, the wide production conversion material may convert the source light within the source wavelength range into a first interim ight within a first interim wavelength range. Similarly, the narrow production conversion material may convert the source light within the source wavelength range into a second interim light within a second interim wavelength range. The first interim light and the second interim light in the converted light may be included within the converted wavelength range. A method may additionally include combining the converted light and at least a part of the source light to create white light.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Figure 15:
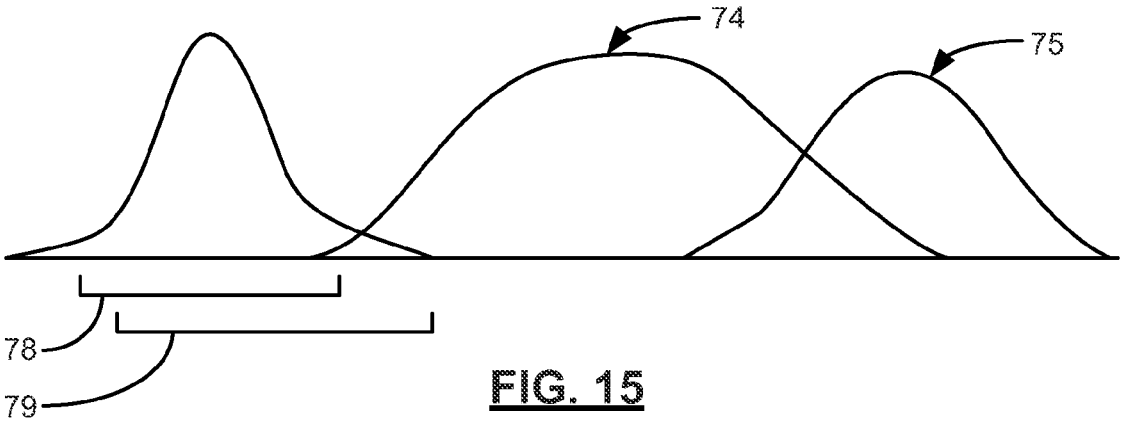
FIG. 15 (Prior Art)
FIGS. 15-16 are waveform diagrams illustrating relative energy of light within various wavelength ranges according to the prior art.
Figure 16:
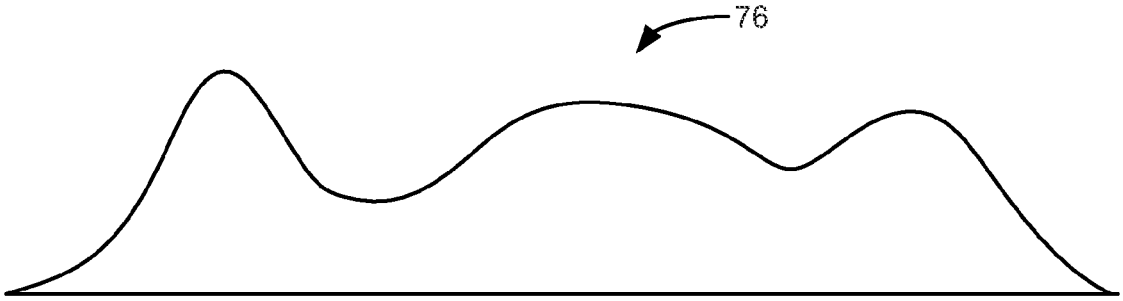
FIG. 16 (Prior Art)

Referring now to FIGS. 1-14 and 17-21, a light converting device 10 according to various embodiments of the present invention is now described in greater detail. Additionally, FIGS. 15-16 disclose conversions of light that are known in the prior art. Throughout this disclosure, the light converting device 10 may also be referred to as a device, enclosure, system or the invention. Alternate references of the light converting device 10 in this disclosure are not meant to be limiting in any way.

Figure 9:
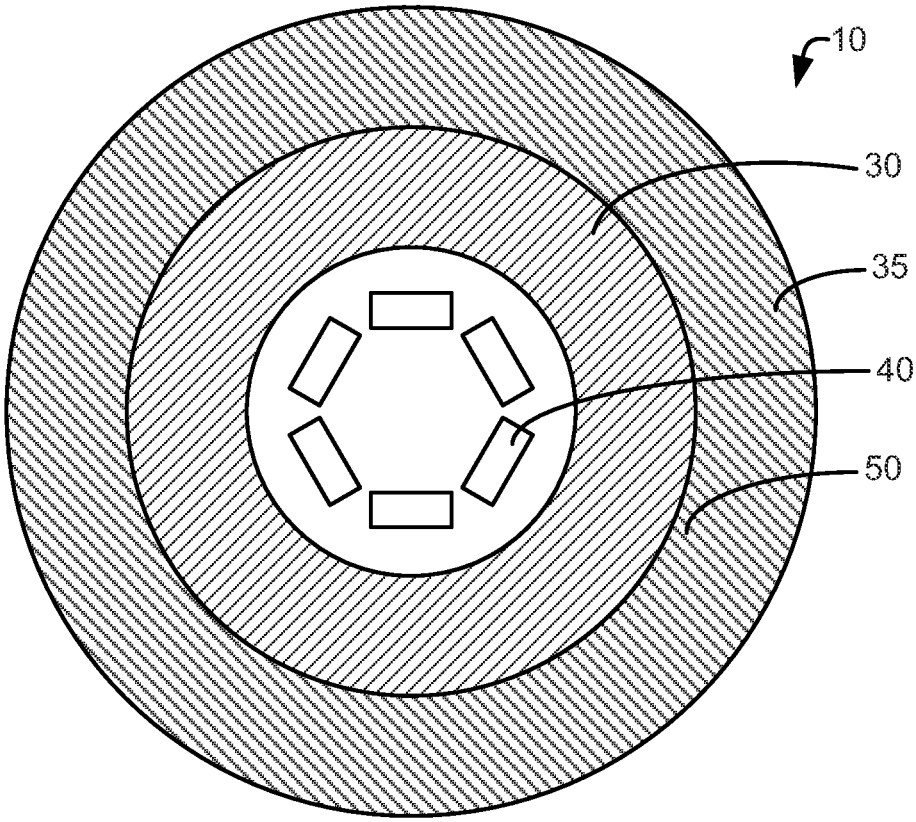
Figure 10:
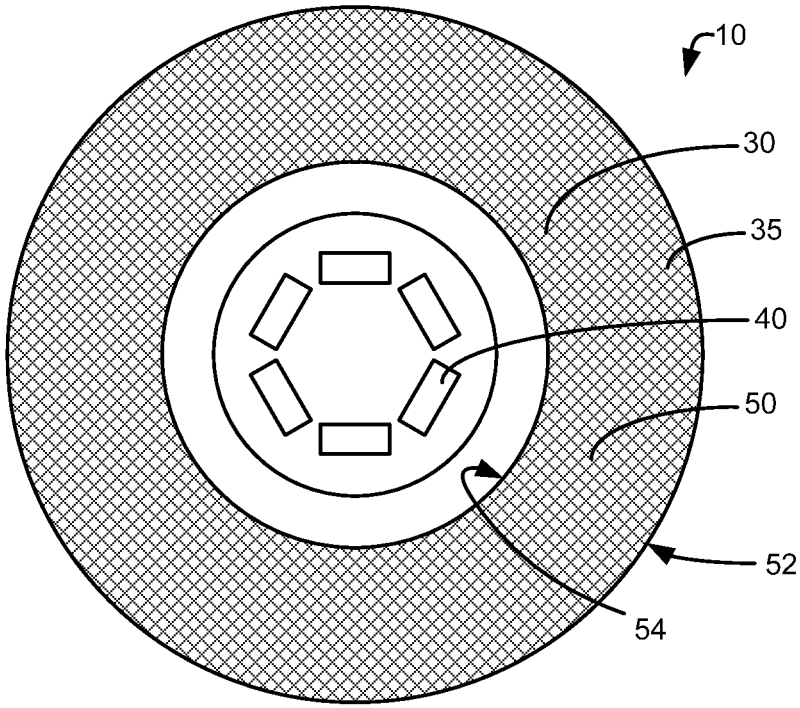
Figure 11:
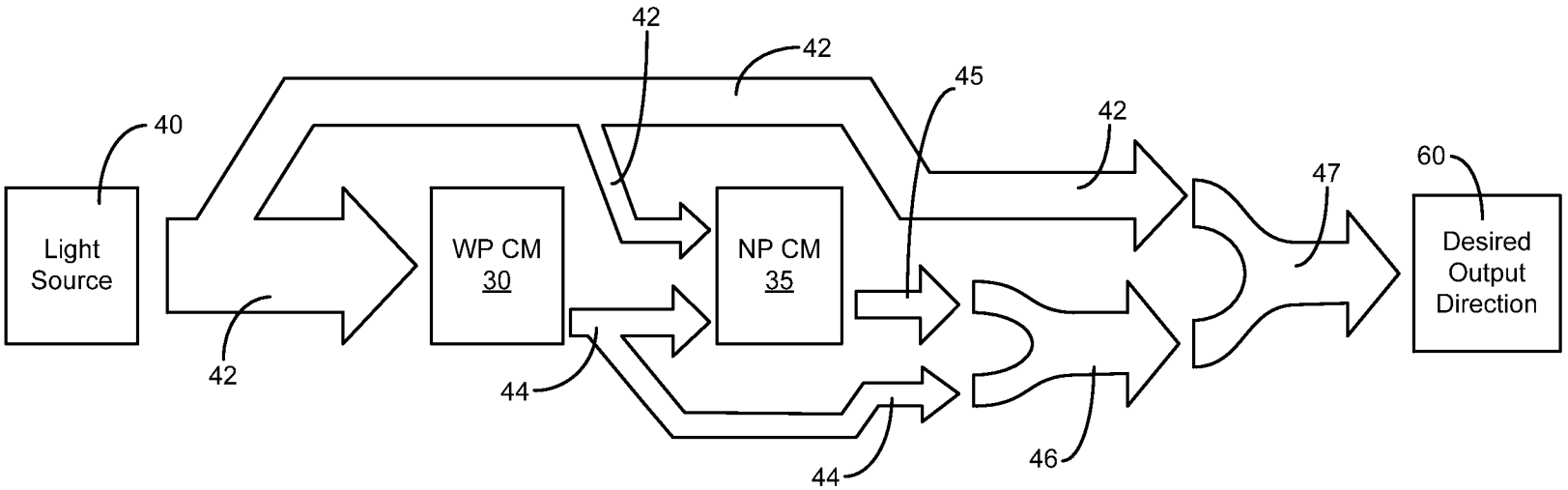
FIGS. 11-13 are a block diagrams illustrating conversion of source light into converted light, according to embodiments of the present invention.
Figure 12:
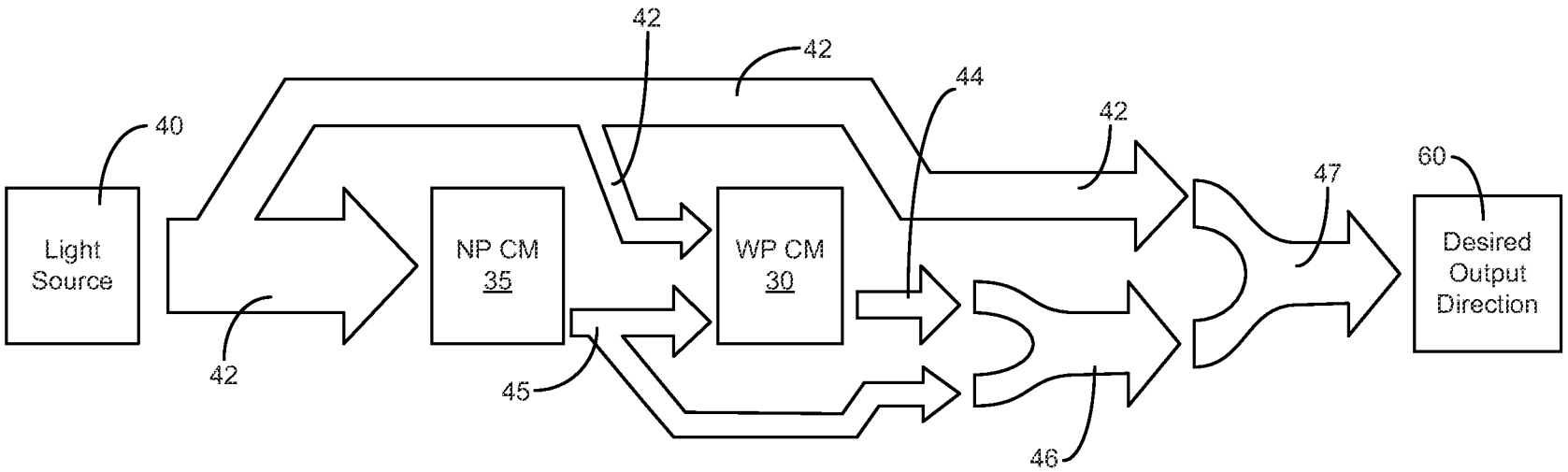
Figure 13:
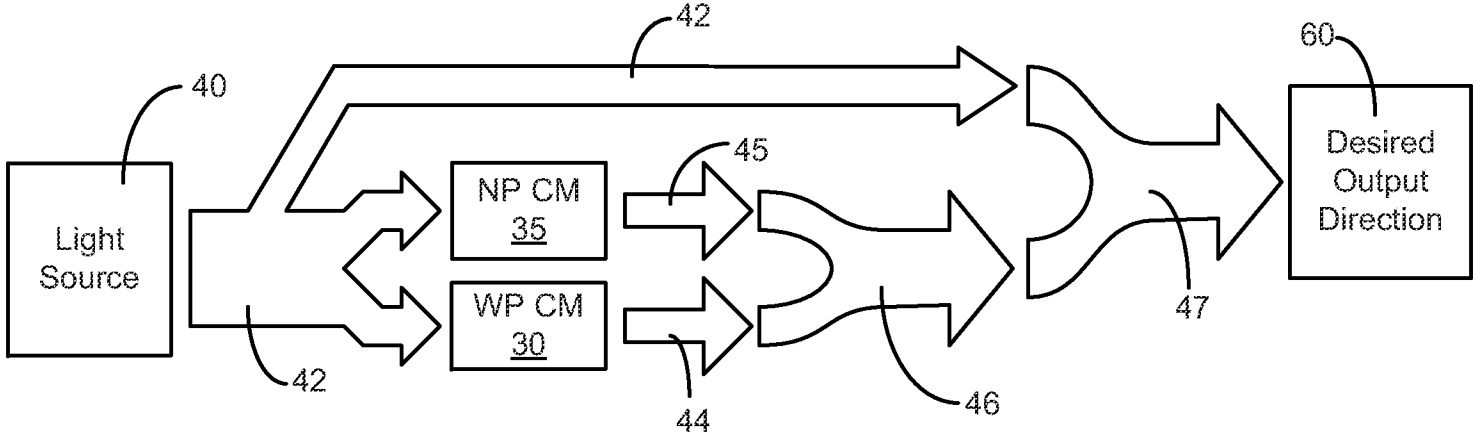

As perhaps best illustrated in FIGS. 1-10, and as also depicted in the block diagram of FIGS. 11-13, the light converting device 10, according to an embodiment of the present invention, may include an enclosure 50 to receive a source light 42 and convert the source light 42 into a converted light 46. The enclosure 50 may receive a source light 42 within a source wavelength range, which may be converted to a converted light 46 within a converted wavelength range. The converted light 46 may be directed by the enclosure 50 to a desired output direction 60. A wide production conversion material 30 and a narrow production conversion material 35 may be located adjacent to the enclosure 50 to convert the source light 42 into the converted light 46. Throughout this disclosure, elements being located adjacent to another object will be understood to also be includable within the other element. Further, positioning an element adjacent to an object or another element is meant to be interpreted in the broadest possible sense, and can further mean contact between the elements and/or element and object, or being positioned substantially close to one another with some space therebetween, or any other interpretation that is not meant to be limiting in any way with respect to the positioning of the two elements. The wide production conversion material 30 and narrow production conversion material 35 may also be located adjacent to a light source 40. The inclusion of conversion materials in the light converting device will be described in greater detail below.

Additionally, the enclosure 50 may be comprised of various sub-enclosures, which may include various conversion materials 30, 35. The sub-enclosures may be located adjacent to one another to perform the dual characteristic color conversion of a source light 42 into a converted light 46. Skilled artisans will appreciate the enclosure 50 may be defined to generally include a bulk material comprising the enclosure 50 and any sub-enclosures that may collectively comprise the enclosure 50. Additionally, the enclosure 50 may feature a combination of conversion materials 30, 35 included within the bulk material of the enclosure 50 or sub-enclosure and/or coatings that include conversion materials 30, 35 applied to the enclosure 50 or sub-enclosures.

The enclosure 50 may receive the source light 42, which may originate from a light source 40. The light source 40 may include light emitting diodes (LEDs) capable of emitting light in a source wavelength range. Other embodiments of the present invention may include source light 42 that is generated by a laser driven light source 40. Those skilled in the art will appreciate that the source light 42 may be provided by any number of lighting devices. A skilled artisan will additionally appreciate that, although the light source 40 is described as using a light emitting semiconductor throughout this disclosure, any light generating structure may be used and remain within the scope and spirit of the present invention.

An LED may emit light when an electrical current is passed across the diode. The LED may be driven by the electrons of the passing electrical current to provide an electroluminescence, or emission of light. The color of the emitted light may be determined by the materials used in the construction of the light emitting semiconductor. The foregoing description contemplates the use of semiconductors that may emit a light in the blue or ultraviolet wavelength ranges. However, a person of skill in the art will appreciate that light may be emitted by light emitting semiconductors of any wavelength range and remain within the breadth of the invention as disclosed herein. Accordingly, a light emitting semiconductor may emit a source light 42 in any wavelength range, since the emitted source light 42 may be subsequently converted by a conversion material 30, 35 applied to the enclosure 50 as it is directed in the desired output direction 60.

The source wavelength range of the source light 42 may include blue or ultraviolet wavelength ranges. However, a person of skill in the art, after having the benefit of this disclosure, will appreciate that LEDs capable of emitting light in any number of wavelength ranges may be used in the light source 40. Additionally, a source light 42 may be emitted by a light source 40 to which a conversion material 30, 35 may be applied. The conversion materials 30, 35 may perform an initial color conversion operation prior to being received by the light converting device 10 of the present embodiment. A skilled artisan will also appreciate, after having the benefit of this disclosure, additional light generating devices that may be used in the light source 40 that are capable of creating illumination.

The present invention may include a light source 40 that generates source light 42 with a source wavelength range in the blue spectrum. The blue spectrum may include light with a wavelength range between 400 and 500 nanometers. A source light 42 in the blue spectrum may be generated by a light emitting semiconductor comprised of materials that emit a light in the blue spectrum. Examples of such light emitting semiconductor materials may include, but are not intended to be limited to, zinc selenide (ZnSe) or indium gallium nitride (InGaN). These semiconductor materials may be grown or formed on substrates, which may be comprised of materials such as sapphire, silicon carbide (SiC), or silicon (Si). In some constructions of light emitting semiconductor materials, such as LEDs, the substrate may be removed during processing. In other LED constructions, the substrate may be removed and the remaining LED device may be bonded to another material. A person of skill in the art will appreciate that, although the preceding semiconductor materials and substrates have been disclosed herein, any semiconductor device capable of emitting a light in the blue spectrum is intended to be included within the scope of the present invention.

Additionally, the present invention may include a light source 40 that generates source light 42 with a source wavelength range in the ultraviolet spectrum. The ultraviolet spectrum may include light with a wavelength range between 200 and 400 nanometers. A source light 42 in the ultraviolet spectrum may be generated by a light emitting semiconductor comprised of materials that may emit a light in the ultraviolet spectrum. Examples of such light emitting semiconductor materials may include, but are not intended to be limited to, diamond (C), boron nitride (BN), aluminum nitride (AlN), aluminum gallium nitride (AlGaN), or aluminum gallium indium nitride (AlGaInN). These semiconductor materials may be grown or formed on substrates, which may be comprised of materials such as sapphire, silicon carbide (SiC), or Silicon (Si). In some LED constructions of light emitting semiconductor materials, such as LEDs, the substrate may be removed during processing. In other LED constructions, the substrate may be removed and the remaining LED device may be bonded to another material. A person of skill in the art will appreciate that, although the preceding semiconductor materials and substrates have been disclosed herein, any semiconductor device capable of emitting a light in the ultraviolet spectrum is intended to be included within the scope of the present invention.

The light source 40 of the present invention may include an organic light emitting diode (OLED). An OLED may be a comprised of an organic compound that may emit light when an electric current is applied. The organic compound may be positioned between two electrodes. Typically, at least one of the electrodes may be transparent.

A person of skill in the art will appreciate that the light converting device 10 according to the present invention may receive a source light 42 that is monochromatic, bichromatic, or polychromatic. A monochromatic light is a light that may include one wavelength range. A bichromatic light is a light that includes two wavelength ranges and may be derived from one or two light sources 40. A polychromatic light is a light that may include a plurality of wavelength ranges, which may be derived from one or more light sources 40. Preferably, the light converting device 10 of the present invention may include a monochromatic source light 42, but a person of skill in the art will appreciate bichromatic and polychromatic light sources 40 to be included within the scope and spirit of the present invention.

For the sake of clarity, references to a source light 42, and its corresponding source wavelength range, should be understood to include the light emitted by the one or more light sources 40 to be received by the enclosure 50 of the light converting device 10. Correspondingly, a source wavelength range should be understood to be inclusive of the wavelength ranges included in monochromatic, bichromatic, and polychromatic source lights 42.

Figure 1:
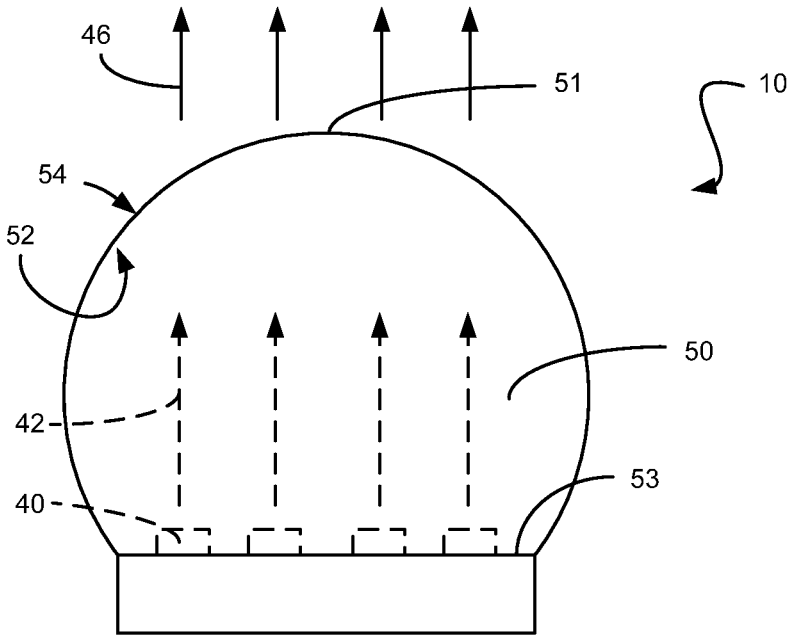
FIG. 1 is a side elevation view of an enclosure of a light converting device according to an embodiment of the present invention wherein the enclosure is positioned to cover a light source.
Figure 2:
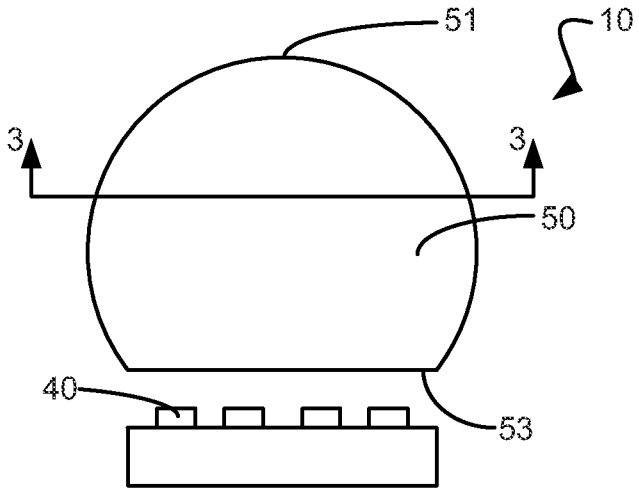
FIG. 2 is a side elevation view of the enclosure of the light converting device illustrated in FIG. 1 being spaced apart from the light source.

Referring now to FIGS. 1 and 2, the enclosure 50, may enclose or encompass the other elements of the light converting device 10. The enclosure 50 may be comprised of a material that is transparent or translucent. Optionally, according to an embodiment of the present invention, the enclosure may be at least partially reflective. Such materials may include, as non-limiting examples, plastic, silicon, glass, polycarbonate materials, or other materials that may allow the pass-through transmission of light.

The enclosure 50 may be a structure of any shape or length, which may partially or entirely enclose the other elements of the light converting device 10 of the present invention. Presented as a non-limiting example, illustrative shapes may include cylindrical, conical, pyramidal, arcuate, round, rectangular, or any other shape. For clarity in the following disclosure, the enclosure 50 will be assumed to be arcuate. A person of skill in the art will appreciate that the use of an arcuate example is provided for clarity purposes only, and thus will not view the following examples to limit the present invention to an arcuate shape.

The enclosure 50 may be defined to include a top portion 51 and a bottom portion 53. The top portion 51 of the enclosure 50 may enclose an interior volume, which may include at least part of the light source 40. A person of skill in the art will appreciate that other embodiments of the light converting device 10 according to the present invention wherein the top portion 51 of the enclosure 50 may not completely enclose the volume within the interior of the enclosure 50 are meant to be included within the scope and spirit of the present invention.

The bottom portion 53 of the enclosure 50 may be at least partially open. The bottom portion 53 of the enclosure 50 may be positioned adjacent to a light source 40. More specifically, the bottom portion 53 may receive the light source 40.

The bottom portion 53 of the enclosure 50 may include an operative connecting structure to secure the enclosure in a location adjacent to the light source 40. The operative connecting structure may include, but should not be limited to, a threaded interface, pegs, rails, tongue and groove joints, sockets, rivets, adhesives, or other type of structure that may secure the enclosure 50 to a location adjacent to the light source 40.

The enclosure 50 may include an inner surface 52 and an outer surface 54. The inner surface 52 may be defined as the surface of the enclosure 50 facing the interior volume enclosed by the enclosure 50. The inner surface 52 may also face a light source 40 located adjacent to the bottom portion 53 of the enclosure 50. However, a person of skill in the art will appreciate alternate locations of the light source 40 to be within the scope of this disclosure. The outer surface 54 may be defined as the surface of the enclosure 50 facing the atmosphere, or outer volume excluded by the enclosure 50. The outer surface 54 may also face the desired output direction 60 to which converted light 46 may be directed.

The enclosure 50 may be removable from the light source 40. Further, the enclosure 50 may advantageously be interchanged with other enclosures 50. As will be described in greater detail below, the interchangeability of enclosures 50 may advantageously provide an ability to alter the color characteristics of the converted light 46.

Referring additionally to FIGS. 3-10, the enclosure 50 may include conversion materials 30, 35 to provide the color converting characteristic. More specifically, the enclosure 50 may include a wide production conversion material 30 and a narrow production conversion material 35. The conversion materials 30, 35 may be applied to a surface 52, 54 of the enclosure 50, according to an embodiment of the present invention. Alternately, one or more conversion material 30, 35 may be included within the material of the enclosure 50. As an example, a conversion material, such as a wide production conversion material 30, may be included within the material of the enclosure 50. This example is illustrated in FIGS. 5-10. In this example, an additional conversion material, such as a narrow production conversion material 35, may be additionally included in the bulk material of the enclosure 50, included in the bulk material of a sub-enclosure, applied to the inner surface 52 or outer surface 54 of the enclosure 50, and/or applied directly to the light source 40.

The light converting device 10 may use a plurality of color conversion materials to convert the source light 42 into converted light 46. The source light 42 may be emitted by one or more light sources 40 such to be received by the light converting device 10. The plurality of color conversion materials 30, 35 may perform an intermediary step of converting the source light 42 into various interim lights 44, 45. The various interim lights may be defined by various interim wavelength ranges, which may differ from the source wavelength ranges of the source light 42 that have undergone conversion.

The following embodiments are provided in the interest of clarity, and without limitation, to illustrate some of many configurations that may allow the dual characteristic color conversion of a source light 42 into a converted light 46. A person of skill in the art will appreciate that additional conversion materials may be included in, or located adjacent to, the enclosure 50. The additional conversion materials may convert the source light 42 into additional interim lights, which may be collectively included in converted light 46.

Referring additionally to FIGS. 11-13, according to an embodiment of the present invention, the wide production conversion material 30 may receive and convert a source light 42 into a first interim light 44. Similarly, the narrow production conversion material 35 may receive and convert a source light 42 into a second interim light 45. The first and second interim lights 44, 45 may be may be included together to comprise the converted light 46. Additionally, the converted light 46 may be included together with a portion of unconverted source light 42 to comprise substantially white light 47.

Figure 3:
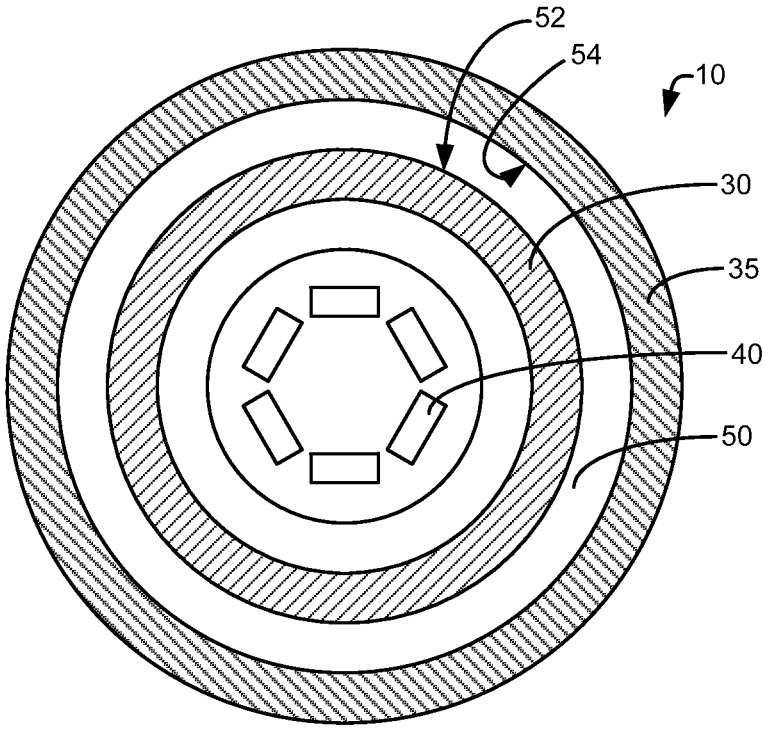
FIGS. 3-10 are cross-sectional plan views various embodiments of a light converting device of the present invention.

Referring now back to FIG. 3, an example of the light converting device 10 will now be discussed. A wide production conversion material 30 may be included in a coating, which may be located adjacent to the inner surface 52 of the enclosure 50. Similarly, the narrow production conversion material 35 may be included in a coating, which may be located adjacent to the outer surface 54 of the enclosure 50. The operation of this example will be described with reference to the flowchart of FIG. 11 in greater detail below.

Figure 4:
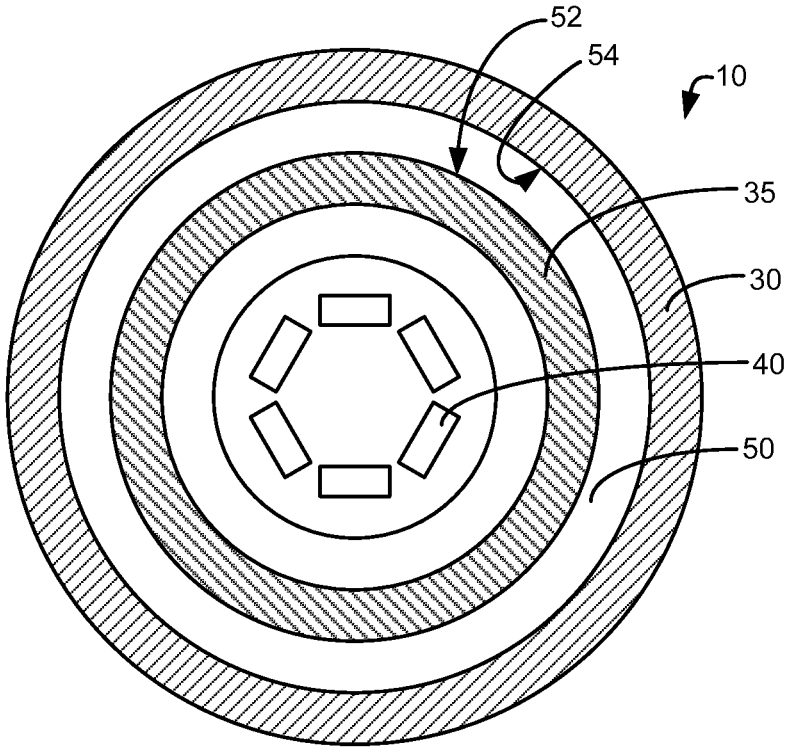

Referring now to FIG. 4, another example of the light converting device 10 will now be discussed. A narrow production conversion material 35 may be included in a coating, which may be located adjacent to the inner surface 52 of the enclosure 50. Similarly, the wide production conversion material 30 may be included in a coating, which may be located adjacent to the outer surface 54 of the enclosure 50. The operation of this example will be described with reference the flowchart of FIG. 12 in greater detail below.

Figure 5:
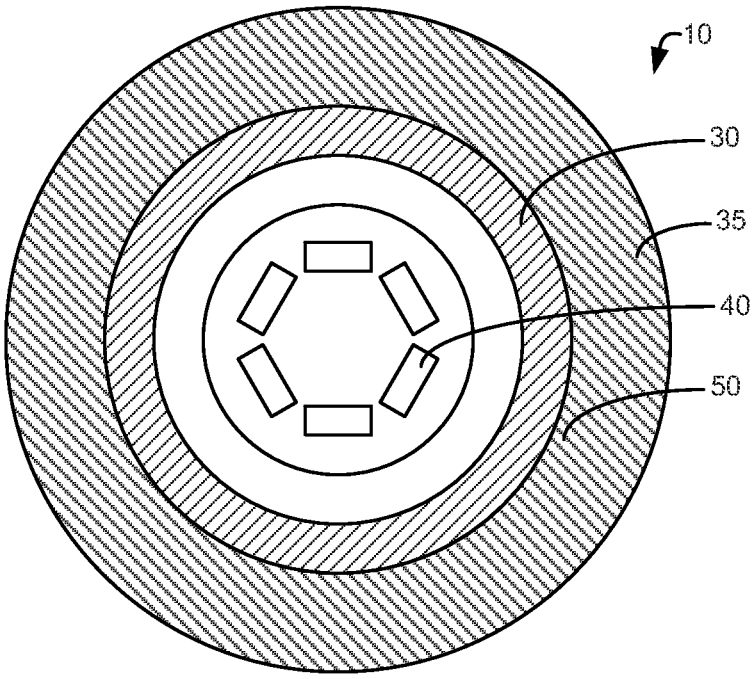

Referring now to FIG. 5, yet another example of the light converting device 10 will now be discussed. A wide production conversion material 30 may be included in a coating, which may be located adjacent to the inner surface 52 of the enclosure 50. Additionally, the narrow production conversion material 35 may be included in the bulk material of the enclosure 50. The operation of this example will be described with reference to the flowchart of FIG. 11 in greater detail below. Alternatively, not pictured in FIG. 5, the narrow production conversion material 35 may be included in a coating, which may be located adjacent to the inner surface 52 of the enclosure 50. The wide production conversion material 30 may be included in the bulk material of the enclosure 50. The operation of this alternate example will be described with reference to the flowchart of FIG. 12 in greater detail below.

Figure 6:
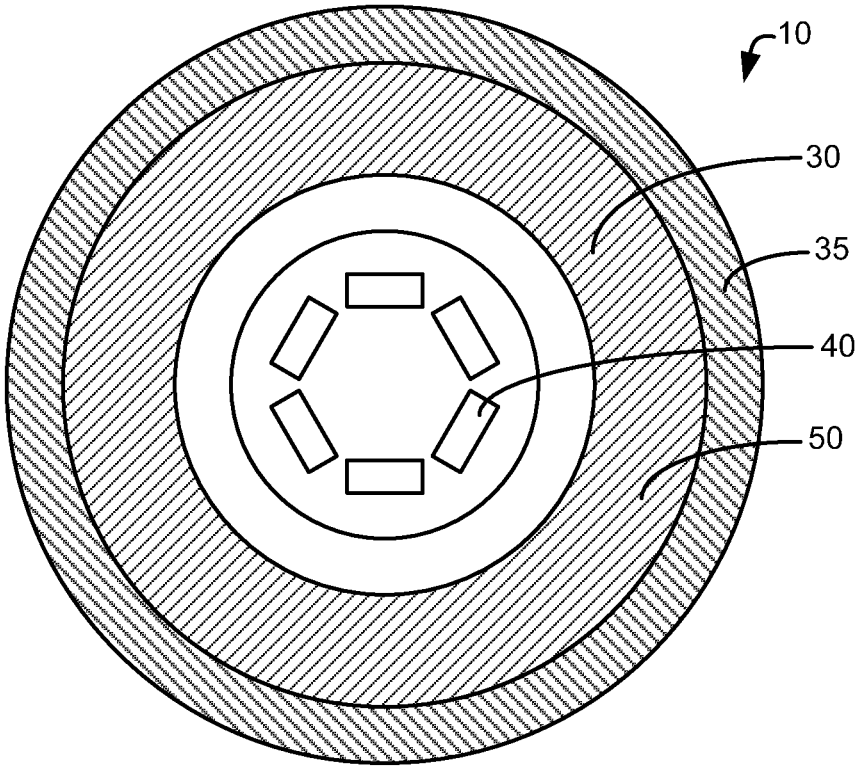

Referring now to FIG. 6, still another example of the light converting device 10 will now be discussed. A narrow production conversion material 35 may be included in a coating, which may be located adjacent to the outer surface 54 of the enclosure 50. Additionally, the wide production conversion material 30 may be included in the bulk material of the enclosure 50. The operation of this example will be described with reference to the flowchart of FIG. 11 in greater detail below. Alternatively, not pictured in FIG. 6, the wide production conversion material 30 may be included in a coating, which may be located adjacent to the outer surface 54 of the enclosure 50. The narrow production conversion material 35 may be included in the bulk material of the enclosure 50. The operation of this alternate example will be described with reference to the flowchart of FIG. 12 in greater detail below.

Figure 7:
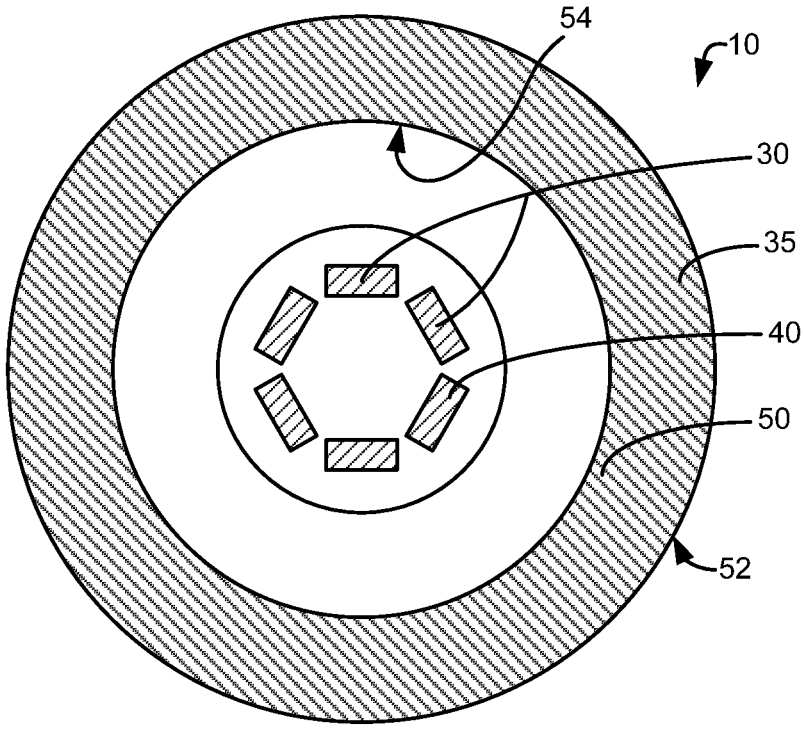

Referring now to FIG. 7, another example of the light converting device 10 will now be discussed. A wide production conversion material 30 may be included in a coating, which may be located adjacent to one or more light source 40. The light source 40 may be at least partially included within the enclosure 50. Additionally, the narrow production conversion material 35 may be included in the bulk material of the enclosure 50. The operation of this example will be described with reference to the flowchart of FIG. 11 in greater detail below.

Figure 8:
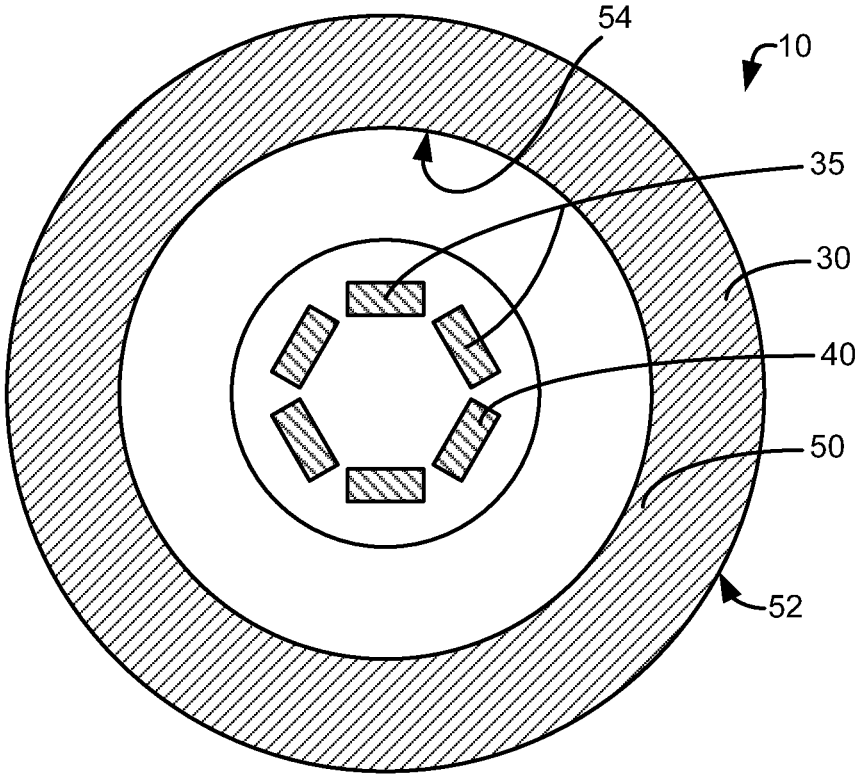

Referring now to FIG. 8, another example of the light converting device 10 will now be discussed. A narrow production conversion material 35 may be included in a coating, which may be located adjacent to one or more light source 40. The light source may be at least partially included within the enclosure 50. Additionally, the wide production conversion material 30 may be included in the bulk material of the enclosure 50. The operation of this example will be described with reference to the flowchart of FIG. 12 in greater detail below.

Referring now to FIG. 9, another example of the light converting device 10 will now be discussed. A wide production conversion material 30 may be included the bulk material of a first sub-enclosure, which may be located at an inner portion of the enclosure 50. Additionally, the narrow production conversion material 35 may be included in the bulk material of the second sub-enclosure, which may be located at an outer portion of the enclosure 50. The first and second sub-enclosures may collectively comprise the enclosure 50. The operation of this example will be described with reference to the flowchart of FIG. 11 in greater detail below. Alternatively, not pictured in FIG. 9, the first sub-enclosure may be located at an outer portion of the enclosure 50 and the second sub-enclosure may be located at an inner portion of the enclosure 50. The operation of this alternative example will be described with reference to the flowchart of FIG. 12 in greater detail below.

Referring now to FIG. 10, still another example of the light converting device 10 will now be discussed. A wide production conversion material 30 and a narrow production conversion material 35 may be included in the bulk material of the enclosure. The wide production conversion material and the narrow production conversion materials may be distributed approximately homogenously. However any distribution of the various conversion materials 30, are to be included within the scope of the present invention. The operation of this example will be described with reference to the flowchart of FIG. 13 in greater detail below.

Referring now to FIG. 11, an example color conversion operation in accordance with an embodiment of the present invention will now be discussed. In this example, the source light 42 may be emitted by a light source 40. At least part of the source light 42 may initially be received by the wide production conversion material 30, which may convert the received source light 42 to emit a first interim light 44. An additional part of the source light 42 may pass the wide production conversion material 30 without undergoing a color conversion.

At least part of the source light 42 that has not been converted by the wide production conversion material 30 may be received by the narrow production conversion material 35, which may convert the received source light 42 to emit a second interim light 45. Additionally, a portion of the first interim light 44 may be received by the narrow production conversion material 35. A negligible quantity of the first interim light 44 may be converted by the narrow production conversion material 35. An additional part of the source light 42 may pass the narrow production conversion material 35, essentially passing the enclosure 50 without undergoing any color conversion. The first and second interim lights 44, 45 may be included together as converted light 46. Similarly, the converted light 46 and unconverted source light 42 may be included together as white light 47.

Referring now to FIG. 12, an example color conversion operation will now be discussed. Similar to the operation of FIG. 11, the source light 42 may be emitted by a light source 40. At least part of the source light 42 may initially be received by the narrow production conversion material 35, which may convert the received source light 42 to emit a second interim light 45. An additional part of the source light 42 may pass the narrow production conversion material 35 without undergoing a color conversion.

At least part of the source light 42 that has not been converted by the narrow production conversion material 35 may be received by the wide production conversion material 30, which may convert the received source light 42 to emit a first interim light 44. Additionally, a portion of the second interim light 45 may be received by the wide production conversion material 30. A negligible quantity of the second interim light 45 may be converted by the wide production conversion material 30. An additional part of the source light 42 may pass the wide production conversion material 30, essentially passing the enclosure 50 without undergoing any color conversion. The first and second interim lights 44, 45 may be included together as converted light 46. Similarly, the converted light 46 and unconverted source light 42 may be included together as white light 47.

Referring now to FIG. 13, an example color conversion operation will now be discussed. In this example, the source light 42 may be emitted by a light source 40. At least part of the source light 42 may initially be received by the wide production conversion material 30 and narrow production conversion material 35 approximately simultaneously. Additionally, at least part of the source light 42 may pass the wide production conversion material 30 and narrow production conversion material 35 remaining unconverted.

The wide production conversion material may convert the received source light 42 to emit a first interim light 44. Additionally, the narrow production conversion material 35 may convert the received source light 42 to emit a second interim light 45. The first and second interim lights 44, 45 may be included together as converted light 46. Similarly, the converted light 46 and unconverted source light 42 may be included together as white light 47.

Referring back to FIGS. 1-2, additional features of the light converting device 10 of the present invention will now be discussed in greater detail. According to an embodiment of the enclosure 50, the top portion 51 of the enclosure 50 may be dosed to enclose the interior volume and a light source 40. In alternate embodiments, at least part of the enclosure, for example the top portion 51, may be open. Light may pass through the transparent or translucent enclosure 50. Similarly, light may pass through any opening in the enclosure, should an opening be present.

As previously mentioned, the conversion materials 30, 35 may be applied to the enclosure 50 to alter the source wavelength range of the source light 42 into a converted wavelength range of a converted light 46. The conversion materials 30, 35 will now be discussed in greater detail. The conversion materials 30, 35 are preferably provided by a fluorescent, luminescent, or phosphorescent material. Examples of such materials may be provided by a phosphor, quantum dot, organic material, or otherwise fluorescent material capable of converting a light with a source wavelength range into a light with a converted wavelength range. More specifically, the wide production conversion material 30 may include a phosphor based wavelength conversion material, and the narrow production conversion material 35 may include a quantum dot based wavelength conversion material. However, it will be appreciated by skilled artisans that any material that may be capable of converting a light from one wavelength range to another wavelength range may be included in the bulk material or applied to the surfaces 52, 54 of the enclosure 50 and be included within the scope and spirit of the present invention.

Luminescence is the emission light without the requirement of being heated. This is contrary to incandescence, which requires the heating of a material, such as a filament through which a current may be passed, to result in illumination. Luminescence may be provided through multiple processes, including electroluminescence and photoluminescence. Electroluminescence may occur as a current is passed through an electronic substance, such as a light emitting diode or a laser diode. Photoluminescence may occur as light from a first wavelength range may be absorbed by a photoluminescent material to be emitted as light in a second wavelength range. Photoluminescent materials may include fluorescent materials and phosphorescent materials.

A fluorescent material may absorb light within a first wavelength range, the energy of which may be emitted as light within a second wavelength range. The absorption and emission operation will be described in greater detail below. A non-limiting example of a fluorescent material may include the coating on a fluorescent light bulb. Fluorescent materials may include, but should not be limited to, phosphors and quantum dots.

Phosphorescent material involves the absorption and emission of light, similar to that of a fluorescent material, however with differing energy state transitions. These differing energy state transitions may result in a delay between the absorption of light in the first wavelength range and the emission of light in the second wavelength range. A non-limiting example of a device with a phosphorescent material may include glow-in-the-dark buttons on a remote controller. Phosphorescent materials may include, but should not be limited to, phosphors.

A phosphor substance may be illuminated when it is energized. Energizing of the phosphor may occur upon exposure to light, such as the source light 42, for example. The wavelength of light emitted by a phosphor may be dependent on the materials of the phosphor. Typically, phosphors may convert a source light 42 into a light characterized by a wide wavelength range, as will be understood by skilled artisans.

A quantum dot substance may also be illuminated when it is energized. Energizing of the quantum dot may occur upon exposure to light, such as the source light 42. Similar to a phosphor, the wavelength of light emitted by a quantum dot may be dependent on the materials of the quantum dot. Typically, quantum dots may convert a source light 42 into a light characterized by a narrow wavelength range, as will be understood by skilled artisans.

The conversion of a source wavelength range into a converted wavelength range may include a shift of wavelength ranges, which may be known to those skilled in the art as a Stokes shift. During a Stokes shift, a portion of the source wavelength range may be absorbed by a conversion material 30. The absorbed portion of source light 42 may include light within a selective wavelength range, such as, for example, a biologically affective wavelength range. This absorption may result in a decreased intensity of light within the source wavelength range.

The portion of the source wavelength range absorbed by the conversion materials 30, 35 may include energy, causing the atoms or molecules of the conversion materials 30, 35 to enter an excited state. The excited atoms or molecules may release some of the energy caused by the excited state as light. The light emitted by the conversion material 30, 35 may be defined by a lower energy state than the source light 42 that may have caused the excited state. The lower energy state may result in wavelength ranges of the converted light 46 to be defined by light with longer wavelengths, such as, for example, the first and second interim light 44, 45.

A person of skill in the art will appreciate additional wavelength conversions that may emit light with shorter wavelength ranges to be included within the scope of the present invention, as may be defined via the anti-Stokes shift. When performing an anti-Stokes shift, a conversion material 30 typically combines two or more photons of a low energy source light 42, which may result in the emission of a single photon of high energy converted light 46.

As will be understood by a person of skill in the art, the energy of the light absorbed by the conversion materials 30, 35 may shift to an alternate energy of light emitted from the conversion materials 30, 35. Correspondingly, the wavelength range of the light absorbed by the conversion materials 30, 35 may be scattered to an alternate wavelength range of light emitted from the conversion materials 30, 35. If a light absorbed by one or more conversion material 30, 35 undergoes significant scattering, the corresponding emitted light may be a low energy light within a wide wavelength range. Substantial scattering characteristics may be definitive of a wide production conversion coating 30. Conversely, if the light absorbed by one or more conversion material 30, 35 undergoes minimal scattering, the corresponding emitted light may be a low energy light within a narrow wavelength range. Minimal scattering characteristics may be definitive of a narrow production conversion material 35. A person of skill in the art will appreciate alternative energy conversions wherein an anti-Stokes shift may occur.

Due to the directional nature of the energy shift performed by the conversion materials 30, 35, the energy of the source light 42 may be converted in one direction to a first or second interim light, 44, 45, which may be included in the converted light 46. In application, a light source 40 may emit a source light 42 to be converted by the conversion materials 30, 35 into a higher energy light via an anti-Stokes shift.

A person of skill in the art will appreciate chromaticity to objectively relate to the color quality of a light, independent from the quantity of its luminance. Additionally, skilled artisans will appreciate that chromaticity may be determined by a plurality of factors, including hue and saturation. The chromaticity of a color may be further characterized by the purity of the color as taken together with its dominant and complimentary wavelength components. In an additional embodiment of the lighting converting device 10 of present invention, one or more conversion materials 30, 35 may be used to generate a desired output color or chromaticity. In an additional embodiment of the present invention, the desired chromaticity may define a non-saturated color.

For example, and without limitation, a plurality of phosphors and/or quantum dots may be used that are capable of converting a high energy source light 42, which may include a high concentration of light in the ultraviolet to blue wavelength ranges, into a lower energy converted light 46, which may include a high concentration of light in the yellow to red wavelength ranges. When the converted light 46 is combined with the unconverted source light 42, white light 47 may be formed. This white light 47 may then be directed in the desired output direction.

For clarity, the following non-limiting example is provided wherein a single light source 40 may emit source light 42 to be received by an enclosure 50 that includes a yellow wide production conversion material 30. A person of skill in the art will appreciate that source light 42 may be received by any number of light sources, according to embodiments of the present invention, and the present example is provided without limiting the light converting device 10 to converting light received from a single light source 40. The yellow conversion material may include a yellow emitting silicate phosphor material. More specifically, as an example, the yellow emitting silicate phosphor may include an ortho-silicate phosphor material, which may be doped with rare earth materials. The light source 40 may be a blue LED. The yellow emitting silicate conversion material may be evenly distributed on the surface of, or in the bulk material of an enclosure 50 located near the light source 40. A uniform distribution of the wide production conversion material 30 may result in the uniform conversion of a blue source light 42 into yellow converted light 46, which may produce an approximately white light 47 when combined with the unconverted source light 42.

The creation of white light 47 may be accomplished by combining the converted light 46 with the source light 42. The converted light may include the first interim light 44 resulting from the wide production color conversion and the second interim light 45 resulting from the narrow production color conversion. The converted light 46 may be within a converted wavelength range, including a high intensity of light defined within the visible spectrum by long wavelengths, such as yellow and red light. The source light 42 may be within a source wavelength range, including a high intensity of light defined within the visible spectrum by short wavelengths, such as blue light. By combining the light defined by short and long wavelength ranges within the visible spectrum, such as blue and yellow light, respectively, a substantially white light 47 may be produced. A person of skill in the art will appreciate the non-uniform location of a wide production conversion material 30 adjacent to the light source 40 to be included within the scope and spirit of embodiments of the present invention.

The preceding example, depicting a yellow emitting silicate conversion material is not intended to be limiting in any way. Instead, the description for the preceding example has been provided for illustrative purposes. A skilled artisan will appreciate that any wavelength range and, therefore, any corresponding color, may be produced by a conversion material 30 and remain within the scope of embodiments of the present invention. Thus, the light converting device 10 discussed herein, is not intended to be limited by the preceding example. Skilled artisans will additionally appreciate that an anti-Stokes shift may be performed by anti-Stokes conversion material. An example of an anti-Stokes conversion material 30, 35 may include, without limitation, yttrium III oxide europium phosphor ($Y_2O_3$:Eu).

Figure 14:
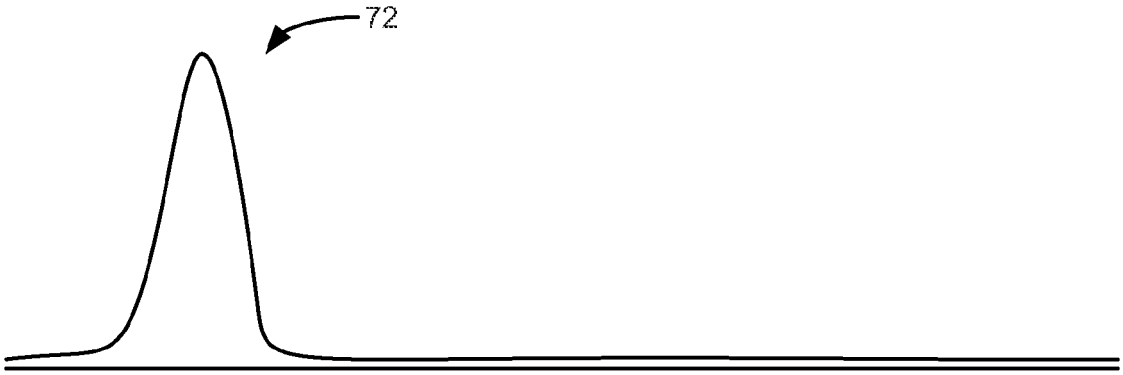
FIG. 14 is a waveform diagram illustrating relative energy of source light within a wavelength range.
Figure 17:
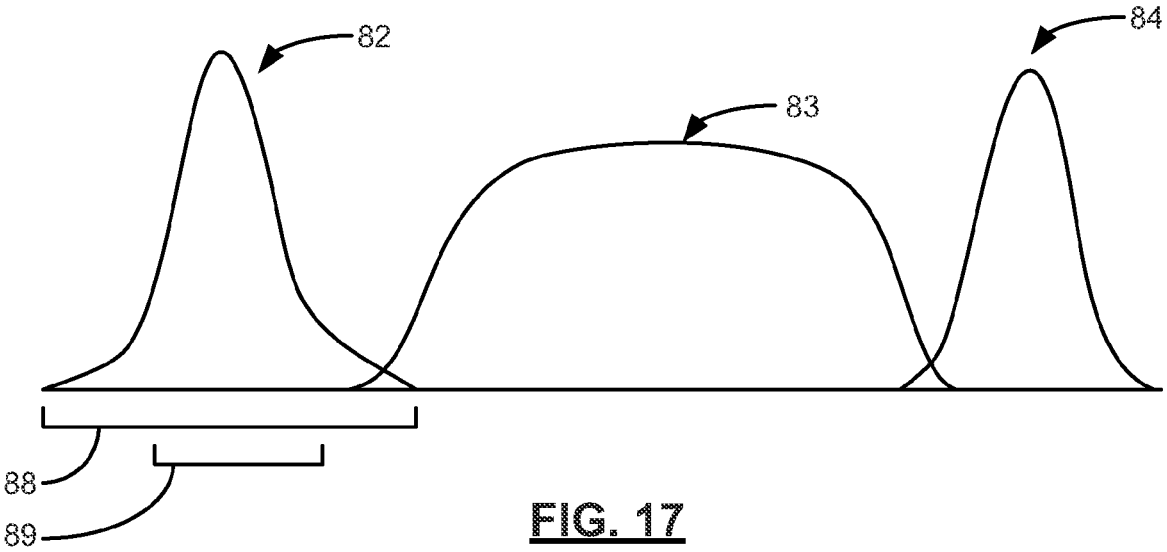
FIGS. 17-18 are waveform diagrams illustrating relative energy of light within various wavelength ranges according an embodiment of the present invention.
Figure 18:
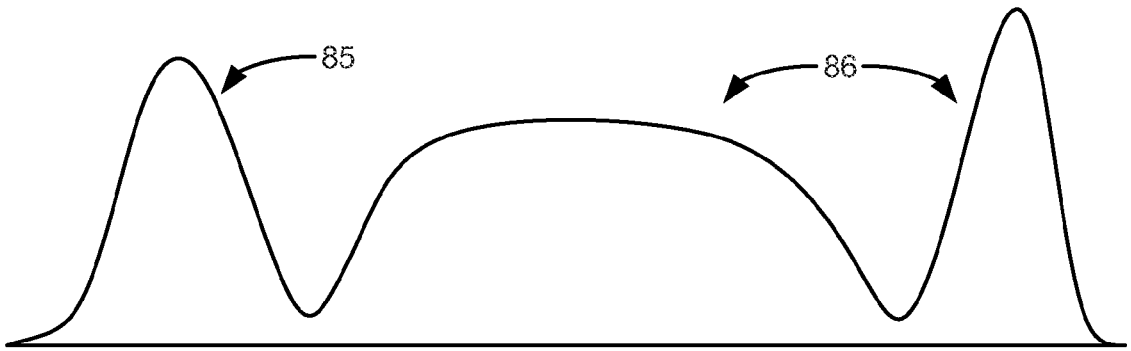

Referring now to FIGS. 14 and 17-18, a series of model waveforms will be discussed to illustrate the conversion of light with various wavelengths, as performed by the light converting device 10 according to an embodiment of the present invention. Additionally, referring to FIGS. 15-16, model waveforms will be have been discussed in the background of this specification to illustrate conversion of light as it is known in the prior art. The waveforms in relation to the embodiments of the present invention are presented as examples to discuss a model color conversion operation, and should not be viewed as limiting the present invention to the present example. Additionally, a person of skill in the art should appreciate a virtually limitless number of source wavelength ranges that may be converted equally numerous converted wavelength ranges to be contemplated by the present invention.

Referring to FIG. 14, an illustrative source light 42 will now be discussed. The source light 42 may be emitted from a light source 40, which may be a blue LED in the present example, to include a narrow wavelength range of high energy light. This high energy source light 42 may include blue light, as perhaps best illustrated by point 72.

Referring additionally to FIG. 17, the color conversion performed by an embodiment of the present invention will now be discussed. The color conversion illustrated in FIGS. 17-18 may be performed by a light converting device 10 that includes a wide production conversion material 30 and a narrow production conversion material 35. The source light 42 may be absorbed by the wide production conversion material 30 and the narrow production conversion material 35. The source light 42 is indicated in FIG. 17 by point 82.

The wide production conversion material 30 may absorb a wide portion of source light 42, which it may convert into a first interim light 44. The first interim light 44 is indicated in FIG. 17 by point 83. Additionally, the narrow production conversion material may absorb a narrow portion of the high energy source light 42, which it may convert into a second interim light 45. The second interim light 45 is indicated in FIG. 17 by point 84.

In the embodiment of the present invention illustrated in FIG. 17, the wide production conversion material 30 and the narrow production conversion material 35 may limit their absorption characteristics to the source wavelength range. For example, the wide production conversion material 30 may include substantially all of the source wavelength range, as illustrated by range 88. Additionally, the narrow production conversion material 35 may include at least part of the source wavelength range, as illustrated by range 89. More specifically, in the present example and without limitation, the narrow production conversion material 35 may include the portion of the source wavelength range with peak levels of luminosity.

In the embodiment wherein the color conversion is performed as a Stokes shift, the first interim light 44 and second interim light 45 may be low energy light. This low energy light may include, for example and without limitation, yellow, orange, and red light. In an example wherein the source light 42 includes a narrow wavelength range of high energy blue light, the wide production conversion material 30 may convert a portion of the blue light into a wide wavelength range of first interim light 44 defined by longer wavelengths, such as yellow, orange, and red light. Additionally, the narrow production conversion material 35 may convert an additional portion of the blue source light 42 into a narrow wavelength range of second interim 45 light defined by longer wavelengths, such as red.

Referring additionally to FIG. 18, the first interim light 44 and second interim light 45 may be included as converted light 46, which is indicated by point 86. The converted light 46 may be further included with at least part of the unconverted source light 42, indicated by point 85, to create approximately white light 47. As illustrated by the waveforms of FIG. 18, the white light 47 produced by an embodiment of the present invention may have an approximately white chromaticity and an increased luminosity over the prior art, advantageously providing a more efficient lighting device.

As will be additionally understood by those skilled in the art, the source light 42 within a source wavelength range may be converted by the wide and narrow production conversion material 30, 35 into a first and second interim light 44, 45, respectively, with multiple interim wavelength ranges. The use of multiple conversion materials 30, such as phosphors, quantum dots, fluorescents, and other conversion materials, may produce a light that includes multiple discrete or overlapping wavelength ranges. These wavelength ranges may be combined to produce the converted light 46. A person of skill in the art will appreciate that references to an interim light within this disclosure, including a first interim light 44 and second interim light 45, and its corresponding interim wavelength ranges, should be understood to include all wavelength ranges that may have been produced as the source light 42 may be converted by a wide or narrow production conversion material 30, 35.

The desired output direction 60 of the converted light 46 generated by the light converting device 10 according to an embodiment of the present invention will now be discussed. After a source light 42 has been converted into a converted light 46, it may be directed in a desired output direction 60. The light converting device 10 of the present invention may project the converted light 46 generally in the desired output direction 60, wherein the directed light may diffuse into a space, such as a room. The converted light 46 directed by the light converting device 10 may thus illuminate the space. Of course, this description is not meant to limit the light converting device 10 of the present invention for use within a space. Instead, those skilled in the art will appreciate that the light converting device 10 according to the present invention may advantageously be used for indoor and/or outdoor illumination.

The light converting device 10, according to an embodiment of the present invention, may advantageously convert the wavelength range of a source light 42 into the converted light 46 and project the converted light 46 in the desired output direction 60 in substantially one operation. More specifically, the light converting device 10 of the present invention may receive a source light 42 and convert the source wavelength range of the source light 42 into a first and second interim wavelength range of a first and second interim light 44, 45, respectively. The first interim light 44 and second interim light 45 may be included as a converted light 46. The converted light 46 may be directed in a desired output direction 60. Additionally, the converted light 46 may be included with the at least part of the source light 42 that has not been converted as white light 47. The white light 47 may also be directed in the desired output direction.

Figure 19:
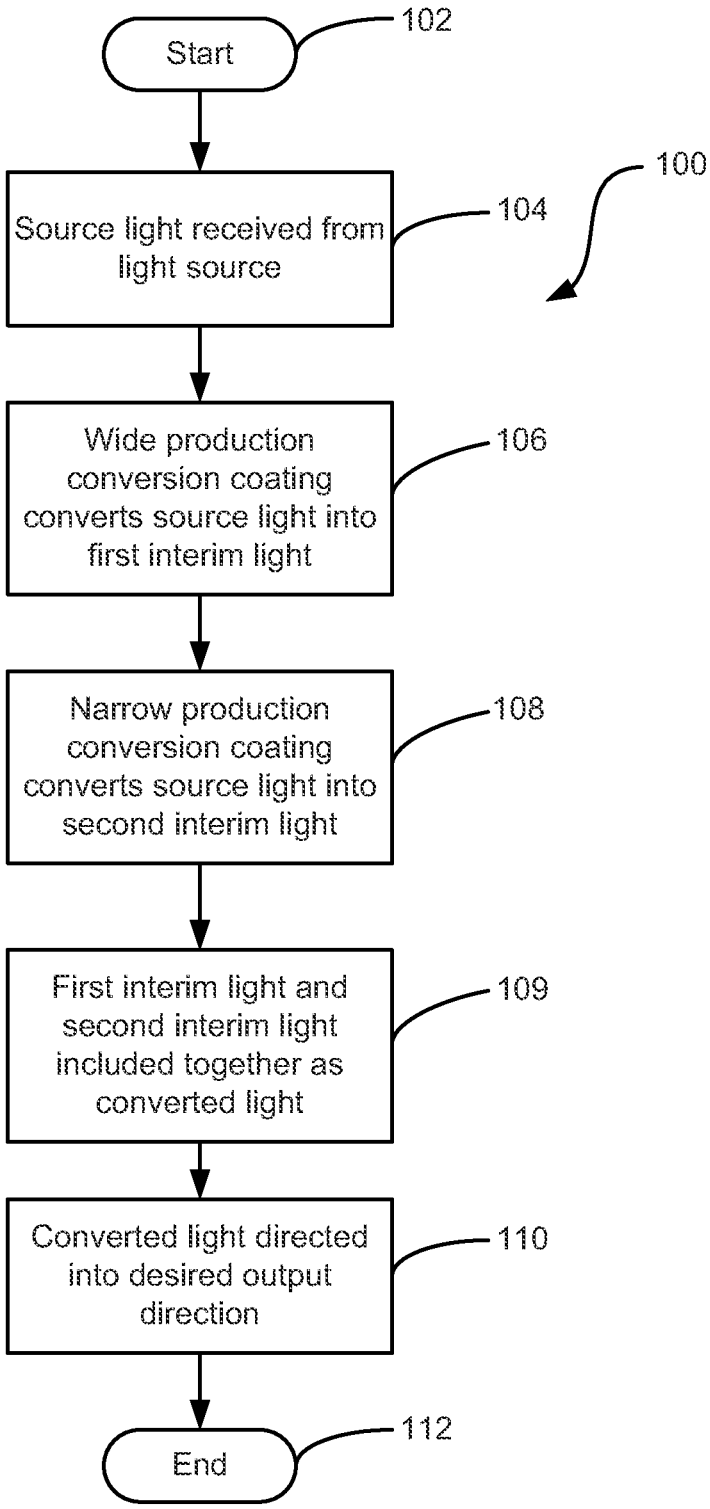
FIGS. 19-21 are flow chart diagrams illustrating a color conversion operation, as performed according to various embodiments of the present invention.

Referring now to the flowchart 100 of FIG. 19, which may be viewed best along with FIG. 11, an example of the emission, conversion, and direction of light, resulting from the operation of an embodiment of the light converting device 10 of the present invention, will now be discussed in greater detail. Starting at Block 102, the source light 42 may be received by the enclosure 50 from the light source 40 (Block 104). As the source light 42 is received by the enclosure 50, at least part of it may be absorbed by the wide production conversion material 30. Accordingly, the source light 42 may be converted into a first interim light 44 (Block 106).

The at least part of the source light 42 that has not been converted by the wide production conversion material 30 may next be absorbed by the narrow production conversion material 35. Accordingly, at least part of this source light 42 may be converted into a second interim light 45 (Block 108). The first interim light and second interim light 44, 45 may be included together as converted light 46 (Block 109). The converted light 46 may then be directed from the enclosure 50 in the desired output direction 60 (Block 110). The operation of the present example may then terminate at Block 112.

Figure 20:
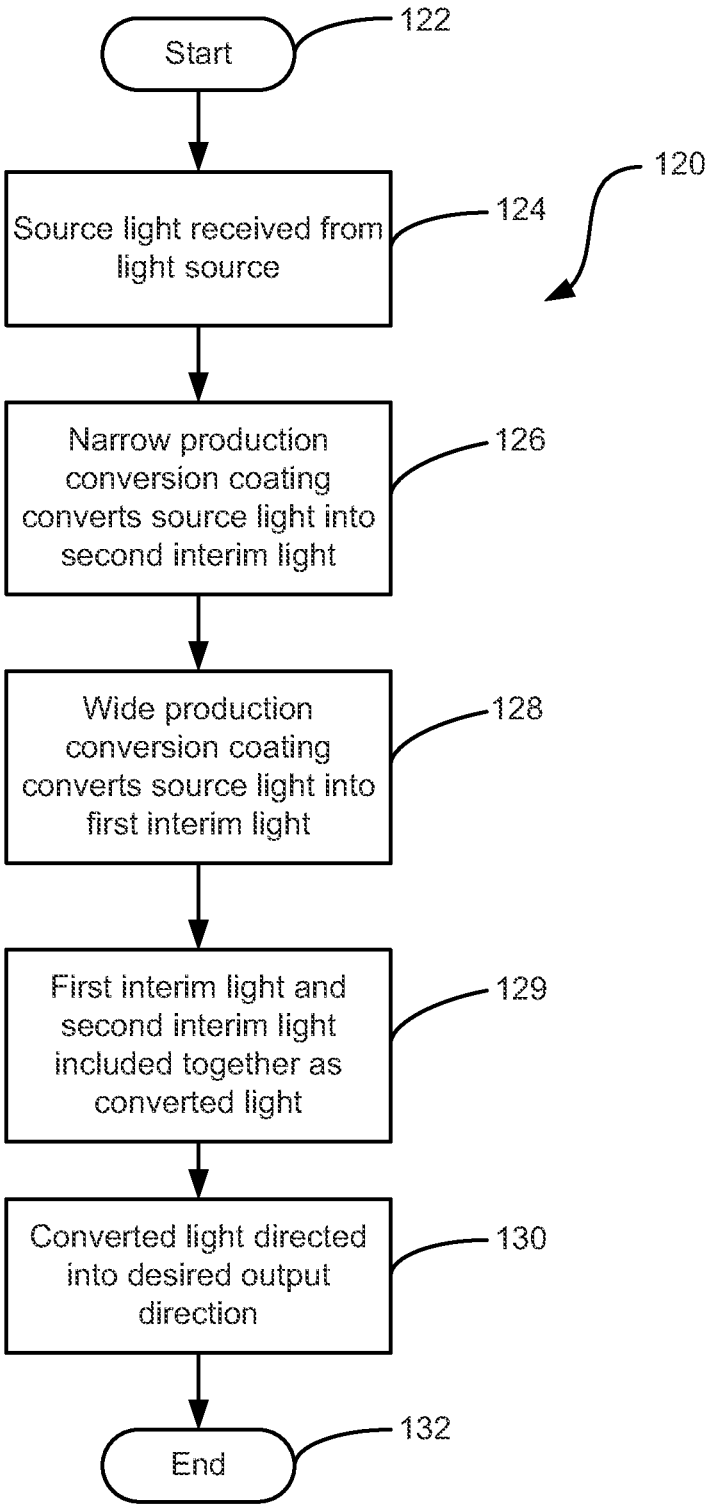

Referring now to the flowchart 120 of FIG. 20, which may be viewed best along with FIG. 12, an example of the emission, conversion, and direction of light, resulting from the operation of an embodiment of the light converting device 10 of the present invention, will now be discussed in greater detail. Starting at Block 122, the source light 42 may be received by the enclosure 50 from the light source 40 (Block 124). As the source light 42 is received by the enclosure 50, at least part of it may be absorbed by the narrow production conversion material 35. Accordingly, the source light 42 may be converted into a second interim light 45 (Block 126).

The at least part of the source light 42 that has not been converted by the narrow production conversion material 30 may next be absorbed by the wide production conversion material 30. Accordingly, at least part of this source light 42 may be converted into a first interim light 45 (Block 128). The first interim light and second interim light 44, 45 may be included together as converted light 46 (Block 129). The converted light 46 may then be directed from the enclosure 50 in the desired output direction 60 (Block 132). The operation of the present example may then terminate at Block 132.

Figure 21:
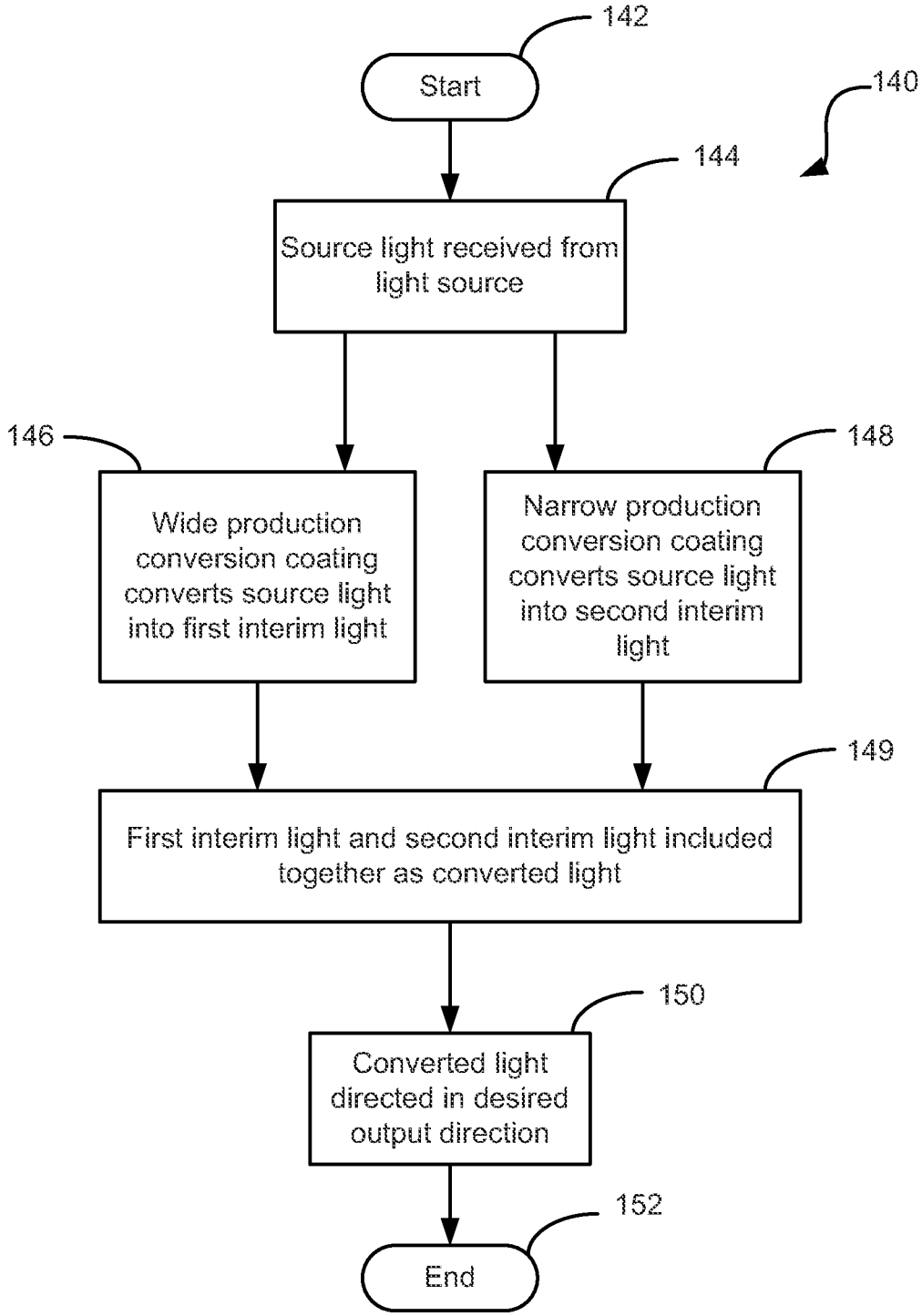

Referring now to the flowchart 140 of FIG. 21, which may be viewed best along with FIG. 13, an example of the emission, conversion, and direction of light, resulting from the operation of an embodiment of the present invention, will now be discussed in greater detail. Starting at Block 142, the source light 42 may be received by the enclosure 50 from the light source 40 (Block 144). As the source light 42 is received by the enclosure 50, at least part of it may be absorbed by the wide production conversion material 30. Accordingly, this source light 42 may be converted into a first interim light 44. Additionally, at least part of the source light 42 may be absorbed by the narrow production conversion material 35, which may be converted into a second interim light 45 (Block 148). The first interim light 44 and second interim light 45 may be included together as converted light 46 (Block 149). The converted light 46 may then be directed from the enclosure 50 in the desired output direction 60 (Block 150). The operation of the present example may then terminate at Block 152.

By using both a wide production conversion material 30 and a narrow production conversion material 35 to convert a source light 42 into a converted light 46, the light converting device 10 of the present invention may advantageously require less conversion material to efficiently perform the color convert operation. Additionally, due to the dual conversion of the source light 42, the light converting device 10 according to an embodiment of the present invention may beneficially reduce the amount source light 42 required to create converted light 46 with a desired converted wavelength range. Furthermore, due to the isolation of conversion materials 30, 35 from the heat generating elements, such as the light source 40, the light converting device 10 of the present invention may advantageously convert the color of light with high efficiency. This reduction of conversion material required to convert the source light 42 into the converted light 46 may advantageously provide increased efficiency and decreased cost of material.

In the foregoing claims, a series of elements may be preceded by the phrase "at least one of." This style for listing elements is intended to define a list of elements from which, one element, a combination of elements, or all elements may be selected. The list preceded by "at least one of" is not intended to solely require at least one of every listed element. Additionally, elements of the present invention may be spatially described as "adjacent to" one another. This style of spatial location is intended to comprise an element of the invention being located near, connected to, or being included within another element, such as, for example, and without limitation, a conversion material being included within the bulk material of an enclosure.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A light converting device comprising:

an enclosure comprised of a bulk material;

a wide production conversion material located adjacent to at least part of the enclosure to convert a source light within a source wavelength range to a first interim light within a first interim wavelength range; and a narrow production conversion material located adjacent to at least part of the enclosure to convert the source light within the source wavelength range to a second interim light within a second interim wavelength range;

wherein the first interim light and the second interim light are substantially included in a converted light;

wherein the first interim wavelength range and the second interim wavelength range are included in a converted wavelength range.

2. A light converting device according to claim 1 wherein the wide production conversion material includes a phosphor.

3. A light converting device according to claim 1 wherein the source light is converted to the first interim light through a Stokes shift of the source wavelength range to the first interim wavelength range.

4. A light converting device according to claim 1 wherein the source light is converted to the first interim light through an anti-Stokes shift of the source wavelength range to the first interim wavelength range.

5. A light converting device according to claim 1 wherein the narrow production conversion material includes a material that is selected from a group consisting of a fluorescent, luminescent, and phosphorescent material.

6. A light converting device according to claim 1 wherein the narrow production conversion material includes a quantum dot.

7. A light converting device according to claim 1 wherein the source light is converted to the second interim light through a Stokes shift of the source wavelength range to the second interim wavelength range.

8. A light converting device according to claim 1 wherein the source light is converted to the second interim light through an anti-Stokes shift of the source wavelength range to the second interim wavelength range.

9. A light converting device according to claim 1 wherein the wide production conversion material is included in a coating, at least part of the source light being converted by the coating.

10. A light converting device according to claim 9 wherein the coating is applied to at least one of the enclosure and the light source.

11. A light converting device according to claim 1 wherein the narrow production conversion material is included in a coating, at least part of the source light being converted by the coating.

12. A light converting device according to claim 11 wherein the coating is applied to at least one of the enclosure and the light source.

13. A light converting device according to claim 1 wherein the wide production conversion material is included in the bulk material of the enclosure.

14. A light converting device according to claim 1 wherein the narrow production conversion material is included in the bulk material of the enclosure.

15. A light converting device according to claim 1 wherein the source light is converted by the wide production conversion material and the narrow production conversion material substantially simultaneously.

16. A light converting device according to claim 1 wherein the source light is a monochromatic light.

17. A light converting device according to claim 1 wherein the source wavelength range is between 200 nanometers and 500 nanometers.

18. A light converting device according to claim 1 wherein the source wavelength range is between 500 and 1300 nanometers.

19. A light converting device according to claim 1 wherein the enclosure encloses at least part of a light source that produces the source light.

20. A light converting device according to claim 1 wherein the source light is emitted by a light emitting semiconductor device.

21. A light converting device according to claim 1 wherein the wide production conversion material is defined by wide absorption characteristics;

wherein the narrow production conversion material is defined by narrow absorption characteristics;

wherein the wide production conversion material absorbs at least some of the source light;

wherein the narrow production conversion material absorbs at least some of the source light that differs from the source light absorbed by the wide production conversion material;

wherein the wide production conversion material absorbs a substantially negligible quantity of the second interim light; and wherein the narrow production conversion material absorbs a substantially negligible quantity of the first interim light.

22. A light converting device according to claim 1 wherein the wide production conversion material is defined by wide scatter characteristics to scatter at least some of the source light by converting the source light that has been absorbed in the source wavelength range and emitting the first interim light in the first interim wavelength range;

wherein the narrow production conversion material is defined by narrow scatter characteristics to scatter at least some of the source light by converting the source light that has been absorbed in the source wavelength range and emitting the second interim light in the second interim wavelength range; and wherein the scattering performed by the wide production conversion material differs from the scattering performed by the narrow production conversion material.

23. A light converting device comprising:

an enclosure comprised of a bulk material;

a wide production conversion material located adjacent to at least part of the enclosure to convert a source light within a source wavelength range to a first interim light within a first interim wavelength range; and a narrow production conversion material located adjacent to at least part of the enclosure to convert the source light within the source wavelength range to a second interim light within a second interim wavelength range;

wherein the first interim light and the second interim light are substantially included in a converted light;

wherein the first interim wavelength range and the second interim wavelength range are substantially included in a converted wavelength range;

wherein the wide production conversion material is defined by wide absorption characteristics and the narrow production conversion material is defined by narrow absorption characteristics;

wherein the wide production conversion material absorbs at least some of the source light and the narrow production conversion material absorbs at least some of the source light that differs from the source light absorbed by the wide production conversion material;

wherein the wide production conversion material absorbs a substantially negligible quantity of the second interim light;

wherein the narrow production conversion material absorbs a substantially negligible quantity of the first interim light;

wherein the wide production conversion material is defined by wide scatter characteristics to scatter at least some of the source light by converting the source light that has been absorbed in the source wavelength range and emitting the first interim light in the first interim wavelength range;

wherein the narrow production conversion material is defined by narrow scatter characteristics to scatter at least some of the source light by converting the source light that has been absorbed in the source wavelength range and emitting the second interim light in the second interim wavelength range;

wherein the scattering performed by the wide production conversion material differs from the scattering performed by the narrow production conversion material.

24. A light converting device according to claim 23 wherein the wide production conversion material includes a phosphor.

25. A light converting device according to claim 23 wherein the source light is converted to the first interim light through a Stokes shift of the source wavelength range to the first interim wavelength range.

26. A light converting device according to claim 23 wherein the source light is converted to the first interim light through an anti-Stokes shift of the source wavelength range to the first interim wavelength range.

27. A light converting device according to claim 23 wherein the narrow production conversion material includes a material that is selected from a group consisting of a fluorescent, luminescent, and phosphorescent material.

28. A light converting device according to claim 23 wherein the narrow production conversion material includes a quantum dot.

29. A light converting device according to claim 23 wherein the source light is converted to the second interim light through a Stokes shift of the source wavelength range to the second interim wavelength range.

30. A light converting device according to claim 23 wherein the source light is converted to the second interim light through an anti-Stokes shift of the source wavelength range to the second interim wavelength range.

31. A light converting device according to claim 23 wherein the wide production conversion material is included in a coating, at least part of the source light being converted by the coating.

32. A light converting device according to claim 31 wherein the coating is applied to at least one of the enclosure and the light source.

33. A light converting device according to claim 23 wherein the narrow production conversion material is included in a coating, at least part of the source light being converted by the coating.

34. A light converting device according to claim 33 wherein the coating is applied to at least one of the enclosure and the light source.

35. A light converting device according to claim 23 wherein the wide production conversion material is included in the bulk material of the enclosure.

36. A light converting device according to claim 23 wherein the narrow production conversion material is included in the bulk material of the enclosure.

37. A light converting device according to claim 23 wherein the source light is converted by the wide production conversion material and the narrow production conversion material substantially simultaneously.

38. A light converting device according to claim 23 wherein the source light is a monochromatic light.

39. A light converting device according to claim 23 wherein the source wavelength range is between 200 nanometers and 500 nanometers.

40. A light converting device according to claim 22 wherein the source wavelength range is between 500 and 1300 nanometers.

41. A light converting device according to claim 23 wherein the enclosure encloses at least part of a light source that produces the source light.

42. A light converting device according to claim 23 wherein the source light is emitted by a light emitting semiconductor device.

43. A method of converting a source light into a converted light using a light converting device that includes an enclosure comprised of a bulk material, a wide production conversion material located adjacent to at least part of the enclosure, and a narrow production conversion material located adjacent to at least part of the enclosure, the method comprising:

receiving the source light by the wide production conversion material and the narrow production conversion material;

converting the source light within a source wavelength range to a first interim light within a first interim wavelength range using the wide production conversion material; and converting the source light within the source wavelength range to a second interim light within a second interim wavelength range using the narrow production conversion material;

wherein the first interim light and the second interim light are substantially included in a converted light;

wherein the first interim wavelength range and the second interim wavelength range are substantially included in the converted wavelength range of the converted light;

wherein the wide production conversion material is defined by wide absorption characteristics;

wherein the narrow production conversion material is defined by narrow absorption characteristics;

wherein the wide production conversion material absorbs at least some of the source light;

wherein the narrow production conversion material absorbs at least some of the source light that differs from the source light absorbed by the wide production conversion material;

wherein the wide production conversion material absorbs a substantially negligible quantity of the second interim light; and wherein the narrow production conversion material absorbs a substantially negligible quantity of the first interim light.

44. A method according to claim 43 wherein the wide production conversion material includes a phosphor.

45. A method according to claim 43 further comprising converting the source light to the first interim light through a Stokes shift of the source wavelength range to the first interim wavelength range.

46. A method according to claim 43 further comprising converting the source light to the first interim light through an anti-Stokes shift of the source wavelength range to the first interim wavelength range.

47. A method according to claim 43 wherein the narrow production conversion material includes a material that is selected from a group consisting of a fluorescent, luminescent, and phosphorescent material.

48. A method according to claim 43 wherein the narrow production conversion material includes a quantum dot.

49. A method according to claim 43 further comprising converting the source light to the second interim light through a Stokes shift of the source wavelength range to the second interim wavelength range.

50. A method according to claim 43 further comprising converting the source light to the second interim light through an anti-Stokes shift of the source wavelength range to the second interim wavelength range.

51. A method according to claim 43 wherein the wide production conversion material is included in a coating, at least part of the source light being converted by the coating.

52. A method according to claim 43 wherein the coating is applied to at least one of the enclosure and the light source.

53. A method according to claim 43 wherein the narrow production conversion material is included in a coating, at least part of the source light being converted by the coating.

54. A method according to claim 53 wherein the coating is applied to at least one of the enclosure and the light source.

55. A method according to claim 43 wherein the wide production conversion material is included in the bulk material of the enclosure.

56. A method according to claim 43 wherein the narrow production conversion material is included in the bulk material of the enclosure.

57. A method according to claim 43 wherein the source light is converted by the wide production conversion material and the narrow production conversion material substantially simultaneously.

58. A method according to claim 43 wherein the source light is a monochromatic light.

59. A method according to claim 43 wherein the source wavelength range is between 200 nanometers and 500 nanometers.

60. A method according to claim 43 wherein the source wavelength range is between 500 and 1300 nanometers.

61. A method according to claim 43 wherein the enclosure encloses at least part of a light source that produces the source light.

62. A method according to claim 43 wherein the source light is emitted by a light emitting semiconductor device.

63. A method according to claim 43 wherein the wide production conversion material is defined by wide scatter characteristics to scatter at least some of the source light by converting the source light that has been absorbed in the source wavelength range and emitting the first interim light in the first interim wavelength range; wherein the narrow production conversion material is defined by narrow scatter characteristics to scatter at least some of the source light by converting the source light that has been absorbed in the source wavelength range and emitting the second interim light in the second interim wavelength range; and wherein the scattering performed by the wide production conversion material differs from the scattering performed by the narrow production conversion material.

* * * * *